US006491589B1

(12) United States Patent
Lochtefeld

(10) Patent No.: US 6,491,589 B1
(45) Date of Patent: Dec. 10, 2002

(54) MOBILE WATER RIDE HAVING SLUICE SLIDE-OVER COVER

(75) Inventor: Thomas J. Lochtefeld, La Jolla, CA (US)

(73) Assignee: Light Wave, Ltd., Reno, NV (US)

( * ) Notice: Subject to any disclaimer, the term of this patent is extended or adjusted under 35 U.S.C. 154(b) by 8 days.

(21) Appl. No.: 09/630,878

(22) Filed: Aug. 2, 2000

Related U.S. Application Data

(60) Provisional application No. 60/146,751, filed on Aug. 2, 1999.

(51) Int. Cl.[7] ..... A63G 21/18

(52) U.S. Cl. ..... 472/117; 472/128; 239/288

(58) Field of Search ..... 472/116, 117, 472/128; 239/288, 288.3, 288.5; 104/53, 69, 70; 405/89, 80, 83, 87

(56) References Cited

U.S. PATENT DOCUMENTS

| | | | | |
|---|---|---|---|---|
| 1,655,498 A | | 1/1928 | Fisch | |
| 3,085,404 A | | 4/1963 | Smith | |
| 3,598,402 A | | 8/1971 | Frenzl | |
| 3,850,373 A | * | 11/1974 | Grolitsch | 239/499 |
| 3,913,332 A | | 10/1975 | Forsman | |
| 4,149,710 A | | 4/1979 | Rouchard | |
| 4,196,900 A | | 4/1980 | Becker et al. | |
| 4,198,043 A | | 4/1980 | Timbes et al. | |
| 4,278,247 A | | 7/1981 | Joppe et al. | |
| 4,429,867 A | | 2/1984 | Barber | |
| 4,564,190 A | | 1/1986 | Frenzl | |
| 4,790,155 A | * | 12/1988 | Daniel et al. | 239/288.5 X |
| 4,792,260 A | | 12/1988 | Sauerbier | |
| 4,805,897 A | | 2/1989 | Dubets | |
| 4,905,987 A | | 3/1990 | Frenzi | |
| 4,954,014 A | | 9/1990 | Sauerbier et al. | |
| 5,020,465 A | | 6/1991 | Langford | |
| 5,125,577 A | * | 6/1992 | Frankel | 239/211 |
| 5,213,547 A | | 5/1993 | Lochtefeld | |
| 5,236,280 A | | 8/1993 | Lochtefeld | |
| 5,271,692 A | | 12/1993 | Lochtefeld | |
| 5,378,197 A | | 1/1995 | Briggs | |
| 5,421,782 A | | 6/1995 | Lochtefeld | |
| 5,427,574 A | | 6/1995 | Donnelly-Weide | |
| 5,453,054 A | | 9/1995 | Langford | |
| 5,638,556 A | | 6/1997 | Kipers et al. | |
| 5,667,445 A | | 9/1997 | Lochtefeld | |
| 5,738,590 A | | 4/1998 | Lochtefeld | |
| 5,899,634 A | | 5/1999 | Lochtefeld | |
| 6,019,547 A | | 2/2000 | Hill | |

FOREIGN PATENT DOCUMENTS

FR 2 671 977 A1 7/1992

OTHER PUBLICATIONS

*PCT International Search Report or the Declaration Nov. 14, 2000.*

* cited by examiner

*Primary Examiner*—Kien T. Nguyen
(74) *Attorney, Agent, or Firm*—Knobbe, Martens, Olson & Bear, LLP.

(57) ABSTRACT

A mobile and compact simulated-wave water ride attraction is provided having one or more sluice slide-over covers for ensuring the safety of riders in the absence of an extended transition surface or using a shortened transition surface. Advantageously, the ride attraction comprises a plurality of transportable modules and other associated components that can be shipped between sites using trucks, trains or other transportation means. The slide-over sluice cover advantageously enables riders to safely slide over the sluice gate and/or injection nozzle without risk of injury or interference with ride operation. The sluice cover comprises a contoured flexible pad which covers and extends over the top surface of the sluice gate. A flexible tongue is provided which is urged downward squeezing against the flow and sealing the nozzle area off from possible injurious contact from a rider. The shape of the tongue also provides a short transition surface over the top of which a rider can slide without injury. A padded fixed decking is provided and in conjunction with the sluice cover it allows the rider to perform a variety of new and exciting skimming/surfing tricks and maneuvers.

57 Claims, 14 Drawing Sheets

MOBILE WATER RIDE HAVING SLUICE SLIDE-OVER COVER

RELATED APPLICATIONS

This application claims the benefit of U.S. Provisional Application No. 60/146,751, filed Aug. 2, 1999, incorporated by reference herein.

BACKGROUND OF THE INVENTION

1. Field of the Invention

The present invention relates to simulated wave water ride attractions of the type wherein an upward flow of water is provided on an inclined ride surface and, more particularly, to a mobile water ride attraction having a sluice slide-over cover overlying a water ride injection nozzle or sluice gate for ensuring the safety of riders in the absence of an extended transition surface between the ride surface and the nozzle or sluice gate.

2. Description of the Related Art

Conventional sheet-flow wave-simulating water rides typically include a sloped ride surface upon which a supercritical flow of sheet-like water is caused to flow. The water flowing up and over or spilling off the side of the inclined surface is collected in supplementary pools or moats and then recirculated back through a channel to an elevated container and/or a pump reservoir from which the water is extruded back onto the incline. Riders are able to ride and perform surfing/skimming maneuvers upon the upward flowing sheet water flow using a skim board, boogie board or a specially configured surf-board/flow-board. By skillfully manipulating the ride board riders can achieve various conditions of dynamic balance or imbalance between the tangentially acting drag forces and the downward acting gravitational forces. See, for example, U.S. Pat. Nos. 5,236,280 and 5,271,692, each of which is incorporated herein by reference.

An elongated nozzle or sluice gate is typically provided adjacent the lower end of the ride surface for injecting a sheet-like flow of water onto the ride surface. Typically, an extended horizontal or downward sloping transition surface is provided between the nozzle and the lower end of the ride surface. The purpose of the extended transition surface is to provide an energy-absorbing buffer between the upward sloped ride surface and the nozzle or sluice gate. This buffer prevents riders from possibly colliding with or riding over the sluice gate and/or interfering with the ride operation.

The incorporation of an extended transition surface, however, undesirably increases the size and cost of the ride attraction. In many applications where such attractions are to be installed it is desirable to maintain as small a footprint as possible in order to conserve precious real estate and also to enable the ride attraction to fit in relatively small confines, such as inside a hotel or restaurant. At the same time, it is desirable to provide as large a riding area as possible in order to maximize rider enjoyment and rider throughput. These competing design objectives can often result in less than optimal ride attraction configurations, particularly in installations where the amount of available space is tight.

Moreover, the relatively large size of such ride attractions makes it difficult, if not impossible, and/or expensive to move them between different sites, for example, between local fairs and the like. Additionally, these water ride attractions are typically constructed on-site which can cause noise and debris, and hence long-term inconvenience to and disruption in the activities of nearby residential and/or business communities. The on-site construction can also undesirably add to the cost.

SUMMARY OF THE INVENTION

Accordingly, it is a principal object and advantage of the present invention to overcome some or all of these limitations and to provide a mobile simulated-wave water ride attraction which can be transported and shipped between sites using conventional trucks, trains and other vehicles.

It is another principal object and advantage of the present invention to overcome some or all of the above limitations and to provide a sluice slide-over cover for ensuring the safety of riders in the absence of an extended transition surface. The sluice cover can be used in conjunction with a wide variety of sheet flow and deep flow simulated-wave water ride attractions, among other types of water rides.

It is another principal object and advantage of the present invention to overcome some or all of the above limitations and to provide a compact simulated-wave water ride attraction which accommodates the omission and/or shortening of the extended transition surface.

In accordance with one embodiment, the present invention provides a nozzle assembly for a water ride attraction. The nozzle assembly comprises a nozzle having an outlet aperture adapted to emit a jet of water onto a ride surface. The nozzle assembly further comprises a nozzle cover. The nozzle cover comprises a padded material substantially covering the nozzle. The nozzle cover includes a flexible tongue which is biased downward against the flow of the water to prevent injury to riders riding over the nozzle.

In accordance with another embodiment, the present invention provides a cover for a water ride sluice gate. The cover comprises a contoured flexible pad and is removably affixed to the sluice gate. The cover includes a flexible tongue at a downstream end. The tongue extends over and is urged downward against the flow of water jetting from the sluice gate. The cover further includes a generally flat portion at an upstream end.

In accordance with yet another embodiment, the present invention provides a water ride attraction. The ride attraction generally comprises a contoured ride surface, a sluice and a cover. The sluice is sized and configured to inject a flow of water onto the ride surface. The cover covers and extends over the top surface of the sluice to advantageously prevent riders from possibly colliding with or riding over the sluice and/or interfering with the ride operation.

In accordance with a further embodiment, the present invention provides a mobile water ride attraction. The ride attraction generally comprises a plurality of nozzles and a plurality of transportable modules and associated components. Each nozzle assembly comprises a nozzle and a nozzle cover. The nozzle has an aperture and is adapted to inject a jet of water. The nozzle cover comprises a flexible padded material to protect riders from possible injurious contact with the nozzle. When the transportable modules and associated components are assembled they form a ride surface. The ride surface is contoured to form a predetermined or preselected wave structure and/or flow pattern.

In accordance with one embodiment, the present invention provides a method of providing a compact wave-simulating water ride attraction. The ride attraction comprises a sluice gate having an outlet for injecting a flow of water onto a ride surface. The method comprises the step of covering the sluice gate with a padded material having a flexible tongue. The tongue extends over the flow of water emitted from the sluice gate outlet. The tongue is biased downwards to squeeze it against the flow of water emitted from the sluice gate outlet to seal off the sluice gate outlet from possible injurious contact with a rider. Advantageously, this permits the ride surface to be configured such that it has a substantially inclined ride surface and a shortened horizontal transition surface.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF THE PREFERRED EMBODIMENTS

Figure 1A:
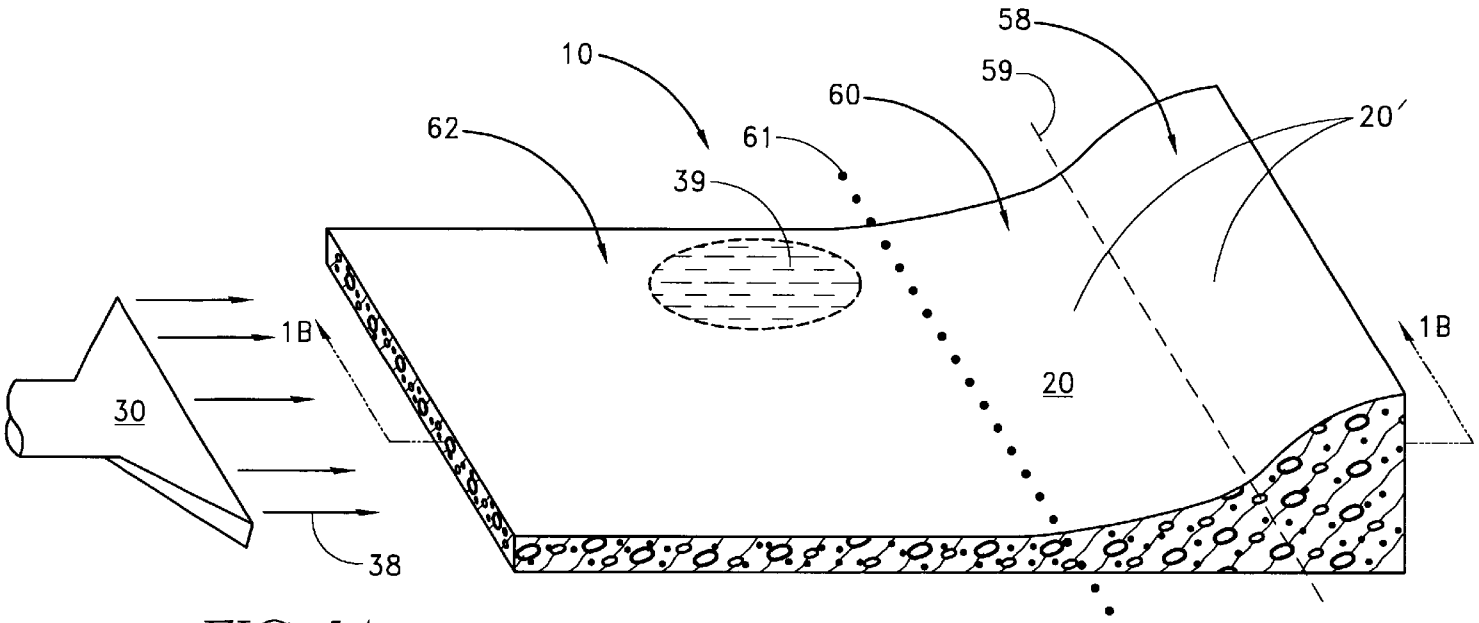
FIG. 1A (PRIOR ART)
FIG. 1A is a side perspective schematic view of a conventional sheet-flow wave-simulating ride attraction having an extended subequidyne transition surface.

To better understand the advantages of the invention, as described herein, an explanation of several important terms used herein is provided. However, it should be pointed out that these explanations are in addition to the ordinary meaning of such terms, and are not intended to be limiting with respect thereto.

Deep water flow is a flow having sufficient depth such that the pressure disturbance from the rider and his or her vehicle are not significantly influenced by the presence of the bottom over which a body of water flows.

Sheet flow or shallow flow is a thin flow of water that: (i) has, at a minimum, sufficient depth to allow water skimming maneuvers, and (ii) has a maximum depth that still allows the pressure disturbance from the rider and his or her vehicle to be significantly influenced by the presence of the bottom over which a body of water flows (i.e., 'a ground effect').

A body of water is a volume of water wherein the flow of water comprising that body is constantly changing, and with a shape thereof at least of a length, breadth and depth sufficient to permit water skimming maneuvers thereon as limited or expanded by the respective type of flow, i.e., deep water or sheet flow.

Water skimming maneuvers are those maneuvers capable of performance on a flowing body of water upon an incline including: riding across the face of the surface of water; riding horizontally or at an angle with the flow of water; riding down a flow of water upon an inclined surface countercurrent to the flow moving up said incline; manipulating the planing body to cut into the surface of water so as to carve an upwardly arcing turn; riding back up along the face of the inclined surface of the body of water and cutting-back so as to return down and across the face of the body of water and the like, e.g., lip bashing, floaters, inverts, aerials, 360's, etc.

Water skimming maneuvers can be performed with the human body or upon or with the aid of a riding or planing vehicle such as a surfboard, bodyboard, water ski(s), inflatable, mat, innertube, kayak, jet-ski, sail boards, etc. In order to perform water skimming maneuvers, the forward force component required to maintain a rider (including any skimming device that he may be riding) in a stable riding position and overcome fluid drag is due to the downslope component of the gravity force created by the constraint of the solid flow forming surface balanced primarily by momentum transfer from the high velocity upward shooting water flow upon said forming surface. A rider's motion upslope (in excess of the kinetic energy added by rider or vehicle) consists of the rider's drag force relative to the upward shooting water flow exceeding the downslope component of gravity. Non-equilibrium riding maneuvers such as turns, cross-slope motion and oscillating between different elevations on the "wave" surface are made possible by the interaction between the respective forces as described above and the use of the rider's kinetic energy.

The equilibrium zone or equidyne region is that portion of a inclined riding surface upon which a rider is in equilibrium on an upwardly inclined body of water that flows thereover; consequently, the upslope flow of momentum as communicated to the rider and his or her vehicle through hydrodynamic drag is balanced by the downslope component of gravity associated with the weight of the rider and his or her vehicle.

The supra-equidyne or superequidyne area is that portion of a riding surface contiguous with but downstream (upslope) of the equilibrium zone wherein the slope of the incline is sufficiently steep to enable a water skimming rider to overcome the drag force associated with the upward water flow and slide downwardly thereupon.

The sub-equidyne area is that portion of a riding surface contiguous with but upstream (downslope) of the equilibrium zone wherein the slope of the incline is insufficiently steep to enable a water skimming rider to overcome the drag force associated with the upward water flow and stay in equilibrium thereon. Due to fluid drag, a rider will eventually move in the direction of flow back up the incline.

Of course, those persons skilled in the art will recognize that the terms equilibrium, supra-equidyne and sub-equidyne, as used herein, are relative terms and may vary depending upon the size, shape, weight and drag coefficient of the actual or hypothetical object placed in the flowing body of water. Nevertheless, they are useful and convenient terms for describing the general characteristics of various flow supporting surfaces as disclosed herein.

The Froude number (Fr) is a mathematical expression that describes the ratio of the velocity of the flow to the phase speed of the longest possible waves that can exist in a given depth without being destroyed by breaking. The Froude number equals the flow speed divided by the square root of the product of the acceleration of gravity and the depth of the water. The magnitude of the Froude number is an indicator of the relative dominance between inertial forces (kinetic energy) and gravity forces (potential energy). A Froude number much greater than one indicates that inertial forces (kinetic energy) are dominant over gravity forces (potential energy) while a Froude number much less than one indicates that gravity forces (potential energy) dominate over inertial forces (kinetic energy). In formula notation, the Froude number may be represented by the following mathematical expression:

$$Fr = \frac{v}{\sqrt{gd}}$$

where, v is the flow velocity (e.g. in ft/sec or m/sec), g is the acceleration due to gravity (e.g. in ft/sec$^2$ or m/sec$^2$) and d is the depth (e.g. in feet or meters) of the sheet or deep water flow.

Subcritical flow can be generally described as a slow/thick water flow. Specifically, subcritical flows have a Froude number (Fr) that is less than 1. If a stationary wave is in a sub-critical flow, then, it will be a non-breaking stationary wave. In formula notation, a flow is subcritical when:

$$Fr<1 \rightarrow V<\sqrt{gd}$$

where, v is the flow velocity (e.g. in ft/sec or m/sec), g is the acceleration due to gravity (e.g. in ft/sec$^2$ or m/sec$^2$) and d is the depth (e.g. in feet or meters) of the sheeting or deep flowing body of water.

Critical flow is evidenced by wave breaking. Critical flow has the characteristic physical feature of the hydraulic jump itself Because of the unstable nature of wave breaking, critical flow is difficult to maintain in an absolutely stationary state in a moving stream of water given that the speed of the wave must match the velocity of the stream to remain stationary. This is a delicate balancing act. There is a match for these exact conditions at only one point for one particular flow speed and depth. Critical flows have a Froude number (Fr) equal to one. In formula notation, a flow is critical when:

$$Fr=1 \rightarrow V=\sqrt{gd}$$

where, v is the flow velocity (e.g. in ft/sec or m/sec), g is the acceleration due to gravity (e.g. in ft/sec$^2$ or m/sec$^2$) and d is the depth (e.g. in feet or meters) of the sheeting or deep flowing body of water.

Supercritical flow can be generally described as a thin/fast flow. Specifically, supercritical flows have a Froude number (Fr) greater than 1. No stationary waves are involved. The reason for the lack of waves is that neither breaking nor non-breaking waves can keep up with the flow speed because the maximum possible speed for any wave is the square root of the product of the acceleration of gravity times the water depth. Consequently, any waves which might form are quickly swept downstream. In formula notation, a flow is supercritical when:

$$Fr<1 \rightarrow V<\sqrt{gd}$$

where, v is the flow velocity (e.g. in ft/sec or m/sec), g is the acceleration due to gravity (e.g. in ft/sec$^2$ or m/sec$^2$) and d is the depth (e.g. in feet or meters) of the sheeting or deep flowing body of water.

The hydraulic jump is the point of wave-breaking of the fastest waves that can exist at a given depth of water. The hydraulic jump itself is actually the break point of that wave. The breaking phenomenon results from a local convergence of energy. Any waves that appear upstream of the hydraulic jump in the supercritical area are unable to keep up with the flow, consequently they bleed downstream until they meet the area where the hydraulic jump occurs; now the flow is suddenly thicker and now the waves can suddenly travel faster. Concurrently, the downstream waves that can travel faster move upstream and meet at the hydraulic jump. Thus, the convergence of waves at this flux point leads to wave breaking. In terms of energy, the hydraulic jump is an energy transition point where energy of the flow abruptly changes from kinetic to potential. A hydraulic jump occurs when the Froude number (Fr) is 1.

Conventional Water Ride Attractions

Figure 1B:
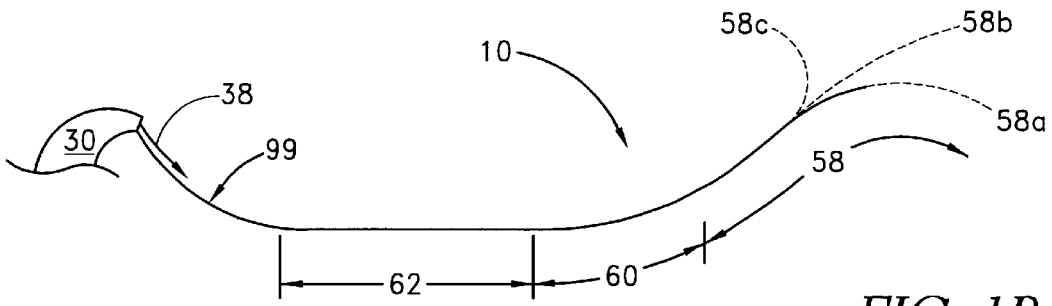
FIG. 1B is a longitudinal schematic cross-section of the incline of FIG. 1A taken along line 1B—1B of FIG. 1A.
Figure 1C:
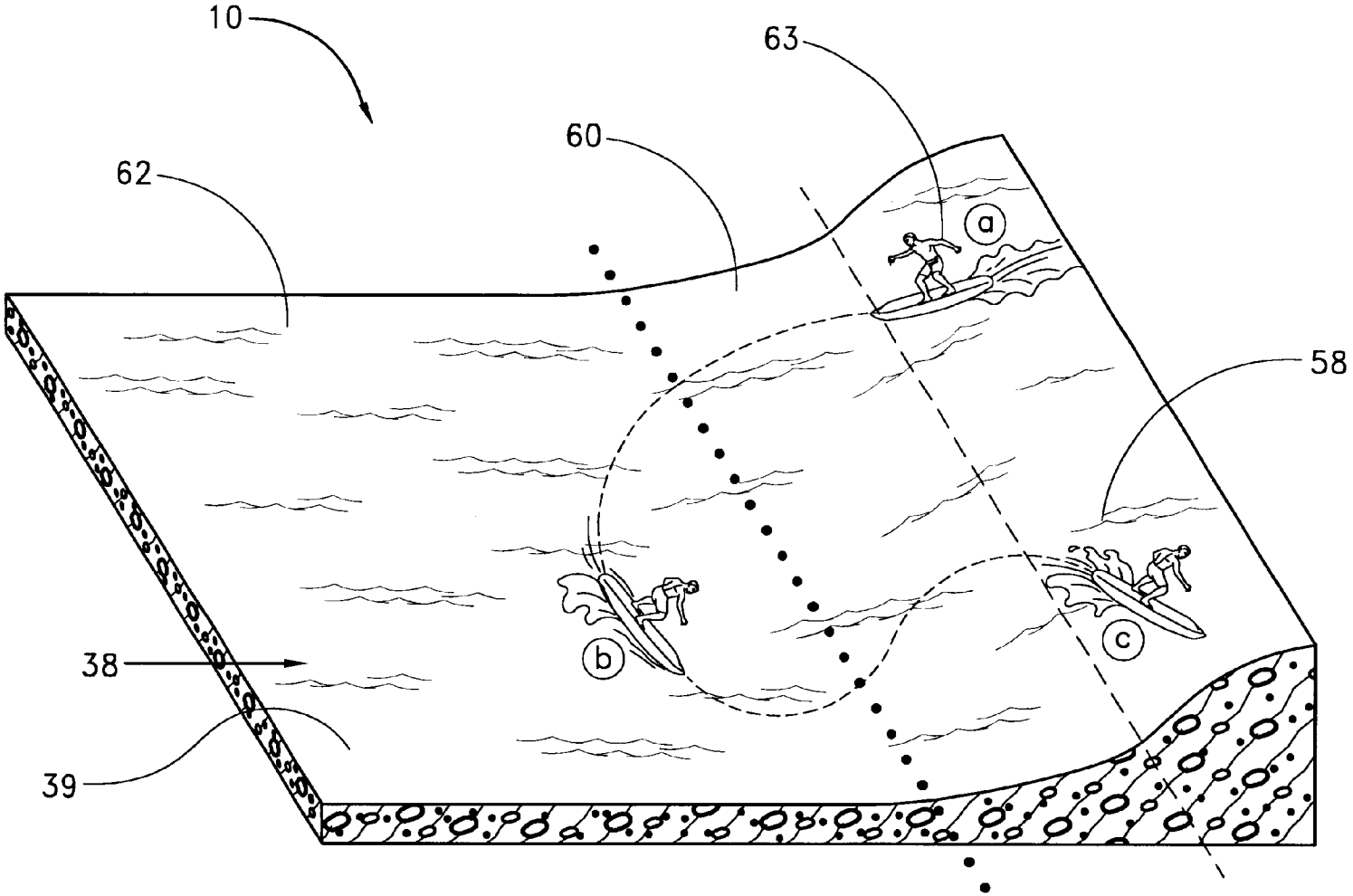
FIG. 1C is a perspective schematic view of the ride attraction of FIG. 1A illustrating a rider extending into the extended subequidyne transition surface.

FIGS. 1A—1C illustrate a conventional sheet-flow wave-simulating ride attraction 10. The attraction 10 includes a ride surface 20 upon which a supercritical flow 39 of sheet-like water 38 is injected by a nozzle or sluice 30. The ride surface 20 includes a sloped ride surface 20', including a superequidyne region 58 and an equidyne region 60, and a subequidyne region 62 which is substantially horizontal. The superequidyne region 58 transitions (as represented by a dashed line 59) to the equidyne region 60, which in turn transitions (as represented by a dotted line 61) to the subequidyne region 62. FIG. 1B also shows a range of configurations 58*a*, 58*b*, 58*c* for the superequidyne area 58.

The elongated nozzle or sluice gate 30 is typically provided adjacent the lower end of the ride surface 20 for injecting the sheet-like flow of water 38 onto the ride surface 20. The subequidyne region 62 serves as an extended horizontal transition surface between the nozzle 30 and the lower end (transition line) 61 of the sloped ride surface 20'. The purpose of the extended transition surface 62 is to provide an energy-absorbing buffer between the upward sloped ride surface 20' and the nozzle or sluice gate 30. This buffer prevents riders from possibly colliding with or riding over the sluice gate 30 and/or interfering with the ride operation. Sometimes, this buffer is accomplished by introducing a reverse curve 99 which transitions from the horizontal of the subequidyne area 62 to an upward arc. Nozzle 30 is then positioned at the upstream edge of reverse curve 99.

As illustrated in FIG. 1C, a rider 63 is able to ride and perform surfing/skimming maneuvers upon the upward flowing sheet water flow 38 using a specially configured surf-board/flow-board. By skillfully manipulating the ride board riders can achieve various conditions of dynamic balance or imbalance between the tangentially acting drag forces and the downward acting gravitational forces. See, for example, U.S. Pat. Nos. 5,236,280 and 5,271,692, each of which is incorporated herein by reference.

More particularly, the rider 63 is able to control his or her position upon supercritical water flow 39 through a balance of forces, e.g., gravity, drag, hydrodynamic lift, buoyancy, and self-induced kinetic motion. For example, rider 63 at position (a) can take advantage of gravitational forces and slide down the upcoming flow by maximizing the hydroplaning characteristics of his ride vehicle and removing drag enhancing hands and feet from the water flow. Likewise, rider 63 can reverse this process at position (b) and move back uphill to position (c) with the flow by properly positioning his or her vehicle to reduce planing ability and/or inserting hands and feet into the flow to increase drag. Non-equilibrium riding maneuvers such as turns, cross-slope motion and oscillating between different elevations on the "wave-like" surface are made possible by the interaction between the respective forces as described above and the use of the rider's kinetic energy.

The extended horizontal riding surface 62 extends up to the lower end 61 of the sloped ride surface 20' and provides a safety buffer between the rider 63 and the nozzle/sluice 30. The horizontal surface 62 can vary in length, but is typically three times the highest elevation of ride surface 20 or 20'. Alternatively, when a reverse curve 99 (FIG. 1B) is used, the length of the horizontal surface (subequidyne area) 62 can be reduced, however, reverse curve 99 still requires increased space, cost and its added height blocks the visibility of spectators who are situated in front of nozzle/sluice 30.

The length of the horizontal surface 62 is designed to be long enough to cause the rider 63 riding down the inclined surface 20' due to gravity, to be slowed down and then propelled back up the incline by the drag force of the supercritical flow 39 of sheet-like water 38. If the horizontal surface 62 were too short in length, the rider could potentially come down the incline 20 and conceivably, overrun the nozzle 30. Thus, the horizontal transition surface 62 typically has a length sufficient to provide enough momentum transfer to push the rider back up the incline 20' before he or she reaches the nozzle/sluice 30.

Figure 2A:
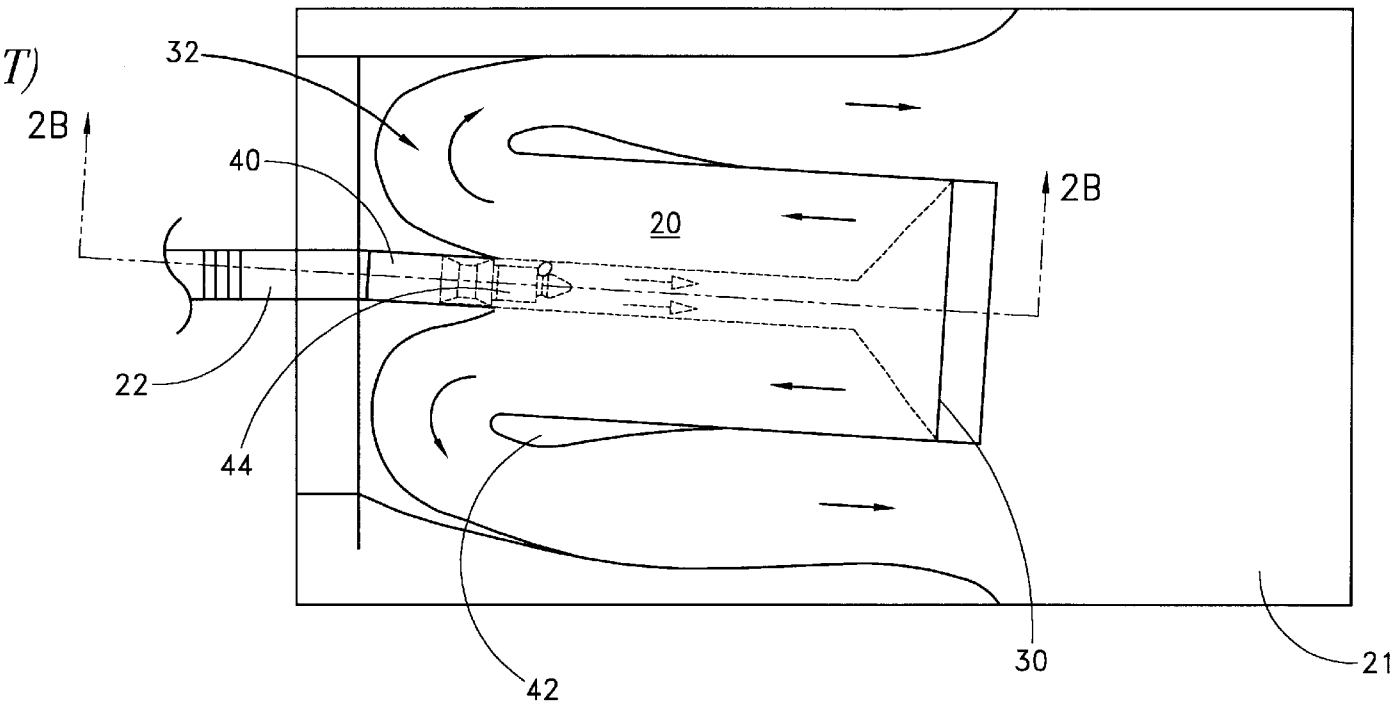
FIG. 2A (PRIOR ART)
FIG. 2A is a top plan view of an alternative embodiment of a conventional sheet-flow wave-simulating ride attraction having an extended subequidyne transition surface.
Figure 2B:
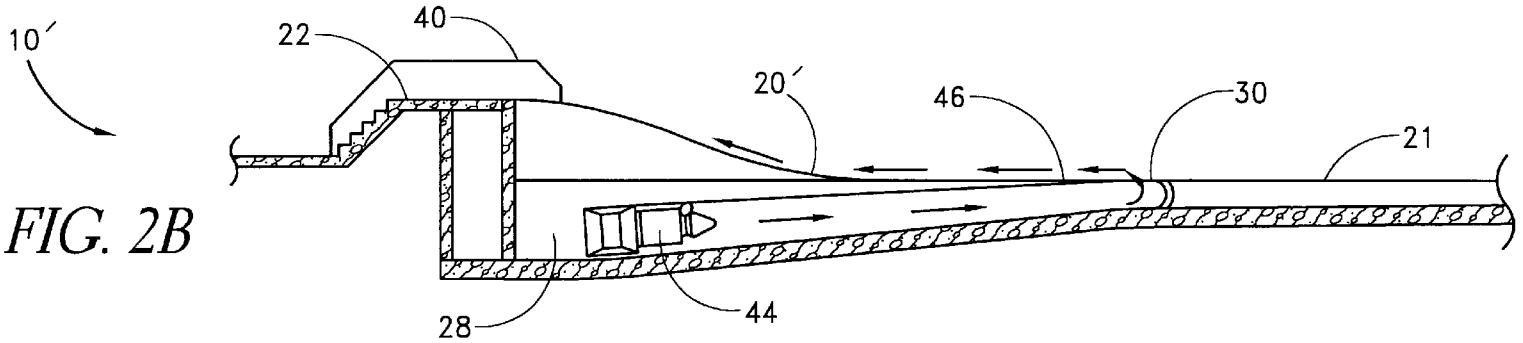
FIG. 2B is a cross-sectional view of the ride attraction of FIG. 2A taken along line 2B—2B of FIG. 2A.

FIGS. 2A—2B illustrate another conventional injected sheet-flow ride attraction 10' specifically for installation adjacent a municipal pool or other associated body of water 21. In this case, the nozzle 30 is positioned at a level substantially equal to or lower than the elevation of the water surface in the pool area 21. A supercritical flow of water is injected onto the ride surface 20 through the nozzle 30 pointed in the direction of flow. However, the nozzle 30 is slightly submerged within the pool 21 so that the nozzle 30 does not obstruct riders flowing over the nozzle area. Thus, riders may ride over the nozzle 30 and be propelled up the inclined surface 20' directly from the pool area 21, which advantageously increases user capacity and throughput As can best be seen in FIG. 2B, the outlet nozzle 30 is located substantially in the center of the pool area 21 and directs water in a unidirectional flow up the inclined surface 20' and around the butterfly return 32. A circulation pump 44 is situated at the deep end of the pool 21. FIG. 2B shows how the incline surface 20 is typically positioned within an existing swimming pool, with the entry ramp 22 and slide 40 at one end of the pool. Also shown are a flow transition area 42 (FIG. 2A) and a sump area 28 (FIG. 2B).

FIG. 2B also shows an extended horizontal transition surface 46 which typically extends at least about 5 meters or about 15 feet in length. As with the ride 10, illustrated above in FIGS. 1A—1C, the horizontal surface 46 is designed to be long enough to cause the rider riding down the inclined surface 20' due to gravity, to be propelled back up the incline 20' by the force of the supercritical flow. If the horizontal surface area 46 were too short in length, the rider would come down the incline 20', and conceivably, overrun the nozzle 30. Thus, the horizontal surface 46 is sufficiently long to provide enough momentum transfer to push the rider back up the incline 20' before he or she reaches the nozzle outlet area 30.

Nozzle Assembly with Slide-Over Cover

FIGS. 3A—3D illustrate one preferred embodiment of a novel injection nozzle assembly 188 for use in conjunction with a water ride attraction and having features in accordance with one preferred embodiment of the present invention. The nozzle/sluice assembly 188 generally comprises a nozzle or sluice gate 130 and a slide-over cover 150 which enables riders to safely slide over the nozzle 130 without risk of injury or interference with ride operation. In one preferred embodiment, a docking or launch pad 190 is provided in communication with the padded cover 150 and above the nozzle 130.

Advantageously, the nozzle/sluice assembly 188 of the present invention when incorporated into a water ride attraction accommodates the omission and/or shortening of the extended transition area typically found in conventional water ride attractions. Desirably, this provides greater flexibility in increasing the available ride area (i.e., the sloped ride surface) for maximum rider enjoyment and also reduces the overall size of the ride attraction, thus facilitating the creation of larger and more exciting waves in tight spaces, such as in hotels, restaurants and the like.

Therefore, the nozzle assembly 188 when used in conjunction with the water ride attraction 10 (FIGS. 1A—1C) will allow omission and/or considerable shortening of the extended transition area 62. Similarly, when the nozzle assembly 188 is used in conjunction with the water ride attraction 10' (FIGS. 2A—2B) the extended transition area 46 can be desirably omitted and/or considerably shortened.

The sluice-gate assembly 188 of the present invention can be efficaciously used in conjunction with a wide variety of water ride attractions, as required or desired, giving due consideration to the goals of providing rider safety, ride attraction compactness, and/or of achieving one or more of the benefits and advantages as taught or suggested herein. These water ride attractions include without limitation sheet flow simulated wave water ride attractions, deep flow simulated wave water ride attractions, among others.

Also, while water is the preferred flow medium the skilled artisan will readily appreciate that a wide variety of other suitable liquids can be efficaciously used, including without limitation colored liquids, liquid mixtures, and various beverages, such as champagne and the like, as needed or desired, giving due consideration to the goals of achieving one or more of the benefits and advantages as taught or suggested herein.

Water (or other liquid) is provided to the nozzle 130 (FIGS. 3A—3D) via a pump 144 (FIG. 3A) and exits the nozzle aperture 192 (see FIGS. 3A and 3B) as supercritical fluid flow 138 (see FIG. 3A) onto a ride surface 120. Preferably, the nozzle 130 is positioned such that the nozzle aperture or opening 192 is located at or just above the level of the end of the ride surface 120. The pump 144 is preferably positioned below the level of the ride surface 120, though it can be located elsewhere as mandated by site specific conditions or as desired.

The nozzle or sluice gate 130 preferably has a generally narrowing or decreasing internal cross-section area in the direction moving away from the pump 144 and towards the nozzle outlet 192. Preferably, the sluice gate or nozzle 130 has a generally beak like shape to minimize the overall height of the sluice gate's fixed decking 190 above the emitted flow 138. In other preferred embodiments, the nozzle or sluice gate 130 may be efficaciously shaped and/or configured in a wide variety of manners, as required or desired, giving due consideration to the goals of achieving one or more of the benefits and advantages as taught or suggested herein.

For an injected sheet flow water ride attraction, the sluice gate 130 is preferably made of either steel, fiberglass, reinforced concrete or other structurally suitable material that can withstand water pressures in the range from about 55 kilopascals to about 310 kilopascals (about 8 psi to about 45 psi or about 0.5 bar to about 3 bar). In other preferred embodiments, the sluice gate 130 can comprise other metals, alloys, ceramics, plastics, composite materials and the like with efficacy, as required or desired, giving due consideration to the goals of providing a suitably strong sluice gate 130, and/or of achieving one or more of the benefits and advantages as taught or suggested herein.

For an injected deep flow water ride attraction, the sluice gate 130 is preferably made of either steel, fiberglass, reinforced concrete or other structurally suitable material that can withstand water pressures in the range from about 14 kilopascals to about 310 kilopascals (about 2 psi to about 45 psi or about 0.1 bar to about 3 bar). In other preferred embodiments, the sluice gate 130 can comprise other metals, alloys, ceramics, plastics, composite materials and the like with efficacy, as required or desired, giving due consideration to the goals of providing a suitably strong sluice gate 130, and/or of achieving one or more of the benefits and advantages as taught or suggested herein.

For an injected sheet flow water ride attraction, the vertical opening of the sluice aperture 192 is preferably about 8 cm (3 inches). In another preferred sheet flow embodiment, the vertical opening of the sluice aperture 192 is in the range from about 4 cm to about 30 cm (about 1.5 inches to about 12 inches). In other preferred embodiments, the sluice gate 130 can be efficaciously sized and/or dimensioned in alternate manners, as required or desired, giving due consideration to the goals of providing a suitable sheet flow, and/or of achieving one or more of the benefits and advantages as taught or suggested herein.

For an injected deep flow water ride attraction, the vertical opening of the sluice aperture 192 is preferably about 61 cm (24 inches). In another preferred sheet flow embodiment, the vertical opening of the sluice aperture 192 is in the range from about 30 cm to about 1.8 m (about 12 inches to about 6 feet). In other preferred embodiments, the sluice gate 130 can be efficaciously sized and/or dimensioned in alternate manners, as required or desired, giving due consideration to the goals of providing a suitable deep water flow, and/or of achieving one or more of the benefits and advantages as taught or suggested herein.

The slide-over sluice gate cover 150 is preferably configured to permit users of an injected sheet- or deep-flow water ride attraction to safely slide over the padded aperture 192 and onto the padded fixed decking 190. The sluice cover 150 preferably comprises a contoured flexible pad which covers and extends over the top surface of the sluice gate 130. Preferably, the sluice cover 150 has a flexible and removable tongue-like pad that is affixed above the sluice aperture 192 and in the downstream direction extends over the water that jets from the sluice aperture 192, and in the upstream direction abuts to the padded fixed decking 190 upon which the user will safely beach.

The tongue-like pad 150 preferably includes a tongue portion 160 that in the downstream direction extends over the jetting water 138, and a rear generally flat portion 170 that in the upstream direction abuts to the padded fixed decking 190. The tongue-like pad 150 also desirably provides a short transition surface over the top of which a rider can slide without injury.

The tongue-like pad 150 (or tongue 160) is preferably urged downward to squeeze against the flow 138 and to seal or cover the nozzle area off from possible injurious contact from a rider. Preferably, the pad 150 (or tongue 160) is spring-loaded in a downward direction to keep a light tension against the jetted water 138. Advantageously, this reduces or minimizes the possibility of a rider catching a finger underneath the pad 150 (or tongue 160) when sliding up and over the pad 150 (or tongue 160) and sluice gate 130. As the skilled artisan will recognize, other suitable resilient means can be efficaciously used to bias or urge the tongue-like pad 150 (or tongue 160) in a downward direction towards the ride surface 120.

The sluice cover (tongue-like pad) 150 can be removably mechanically connected to the nozzle or jet 130 in a wide variety of manners, preferably utilizing screws or the like. Advantageously, this removable feature allows for easy replacement of the sluice cover 150, as needed or desired. In other preferred embodiments, alternate suitable securing means may be efficaciously used to removably attach the sluice cover 150, as required or desired, giving due consideration to the goals of providing reliable, removable and safe attachment, and/or of achieving one or more of the benefits and advantages as taught or suggested herein.

The sluice cover or pad 130 preferably ranges in thickness from about 1.6 mm ($1/16^{th}$ inch) thick at its furthest downstream point to approximately 2.54 cm (1 inch) thick where it abuts to the fixed decking 190. In other preferred embodiments, the sluice cover 130 can be efficaciously sized and/or dimensioned in alternate manners, as required or desired, giving due consideration to the goals of providing a suitably resilient and strong nozzle cover, and/or of achieving one or more of the benefits and advantages as taught or suggested herein.

The sluice cover or pad 130 is preferably made out of any suitable soft flexible material that will avoid injury upon impact, yet rigid enough to hold its shape under prolonged use. Suitable pad materials include a 32 kg/m$^3$ (2 lb/ft$^3$) density closed cell polyurethane foam core that is coated with a tough but resilient rubber or plastic, e.g., polyurethane paint or vinyl laminate. The pad 130 or pad material can be reinforced internally or externally, if needed. In other preferred embodiments, alternate materials may be efficaciously used, as required or desired, giving due consideration to the goals of providing a suitably soft, flexible yet rigid pad, and/or of achieving one or more of the benefits and advantages as taught or suggested herein.

The padded fixed decking 190 can be provided in combination with the nozzle assembly 188 or it can comprise part of the nozzle assembly 188. The decking 190 extends away from the direction of water flow 138 and is located above the level of the nozzle 130. The decking or platform 190 is generally flat and rectangular, and abuts against or is in mechanical communication with the upstream end of the sluice cover 150 to provide a generally smooth transition between the respective upper surfaces of the cover 130 and decking 190. The decking 190 rests at a forward end 194 on the top of the outer surface of the nozzle 130 and at a rear end 196 on top of a support structure or supports 198 (see FIG. 3A). A variety of suitable means, such as screws or the like, may be used to secure and fasten the decking 190 in place.

Figure 3A:
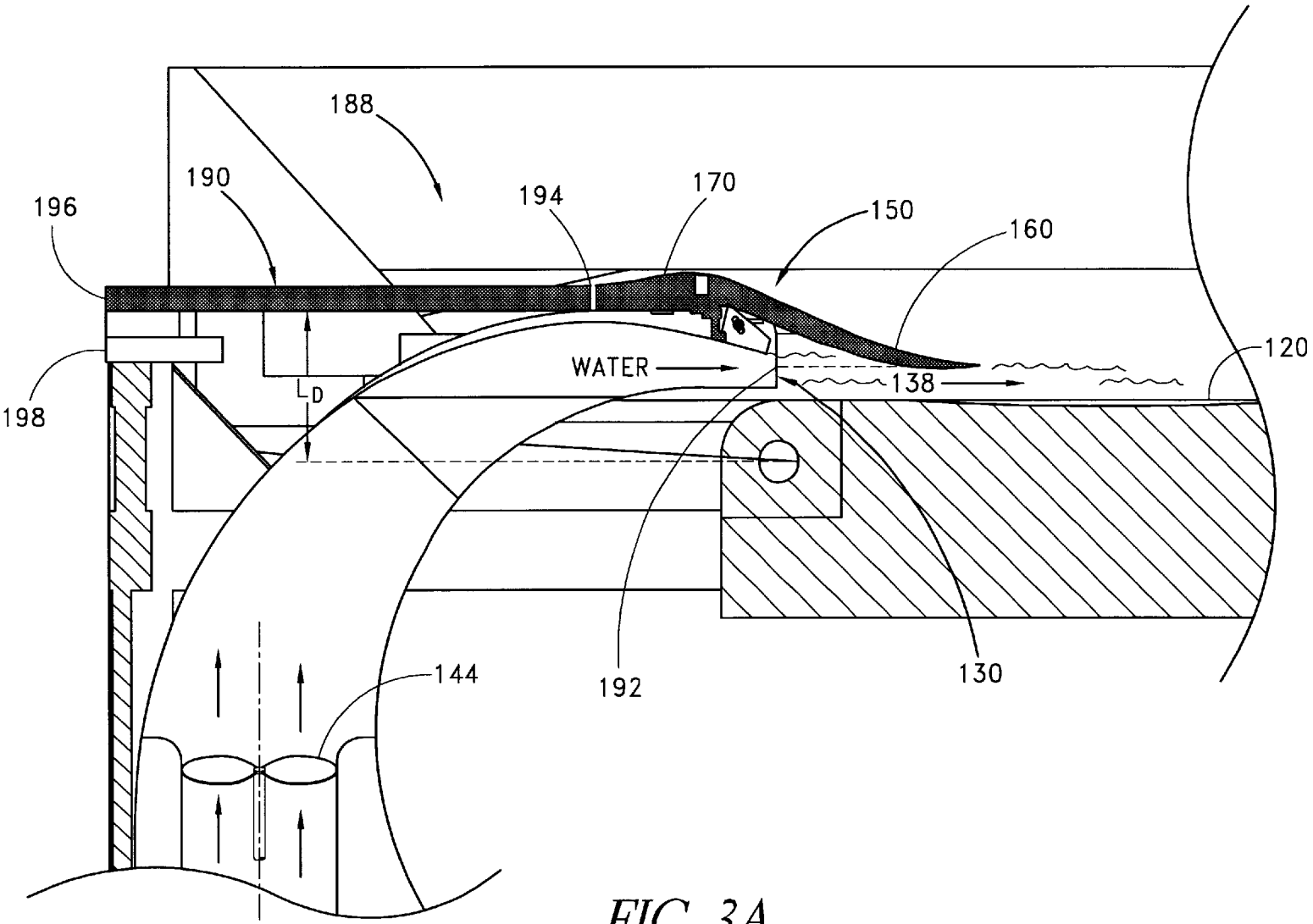
FIG. 3A is a longitudinal cross-section schematic view of a injection nozzle/sluice assembly including a slide-over sluice cover and a decking pad, and having features and advantages in accordance with one preferred embodiment of the present invention.
Figure 3B:
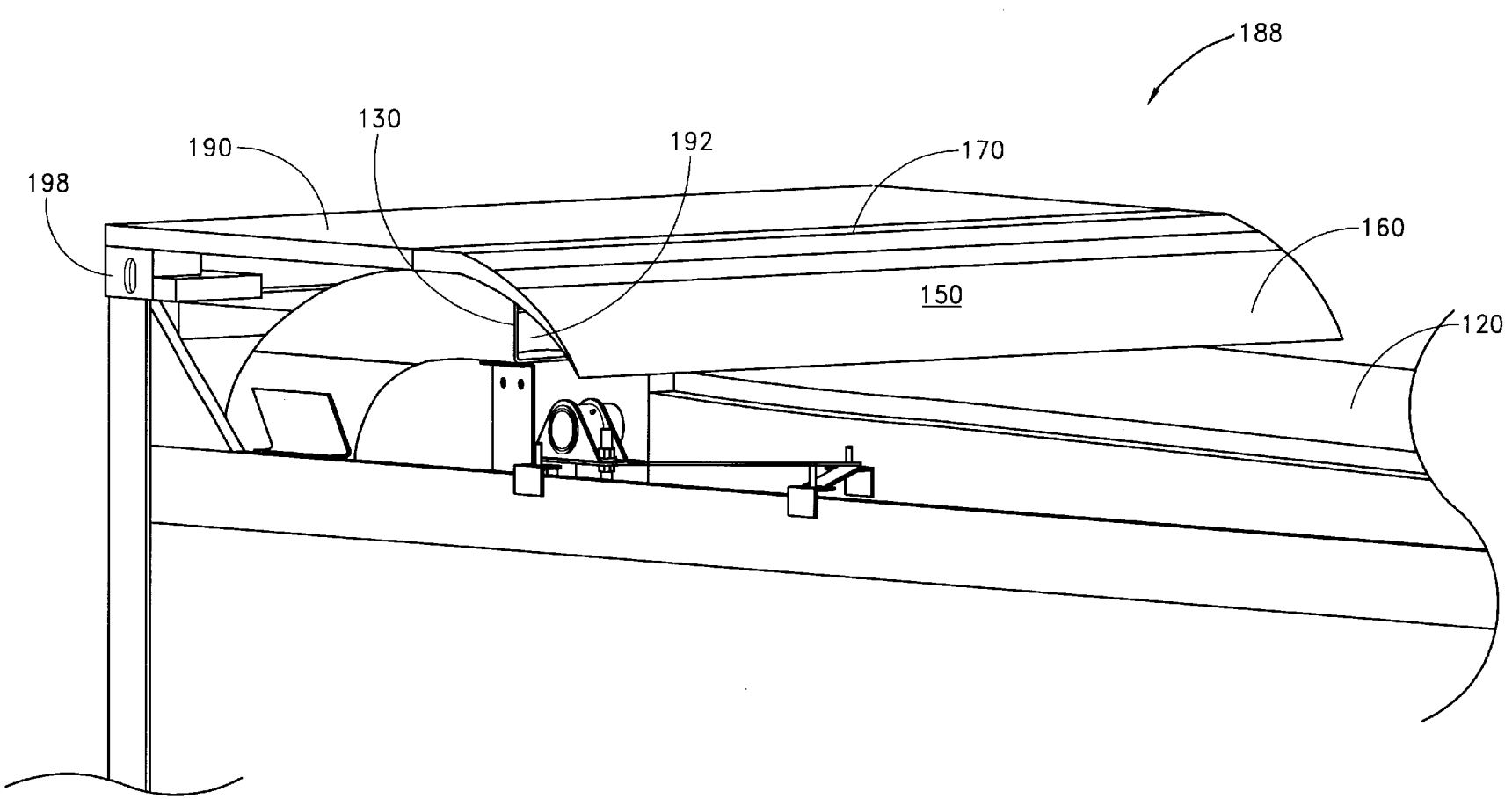
FIG. 3B is a front perspective schematic view of the injection nozzle/sluice assembly of FIG. 3A.
Figure 3C:
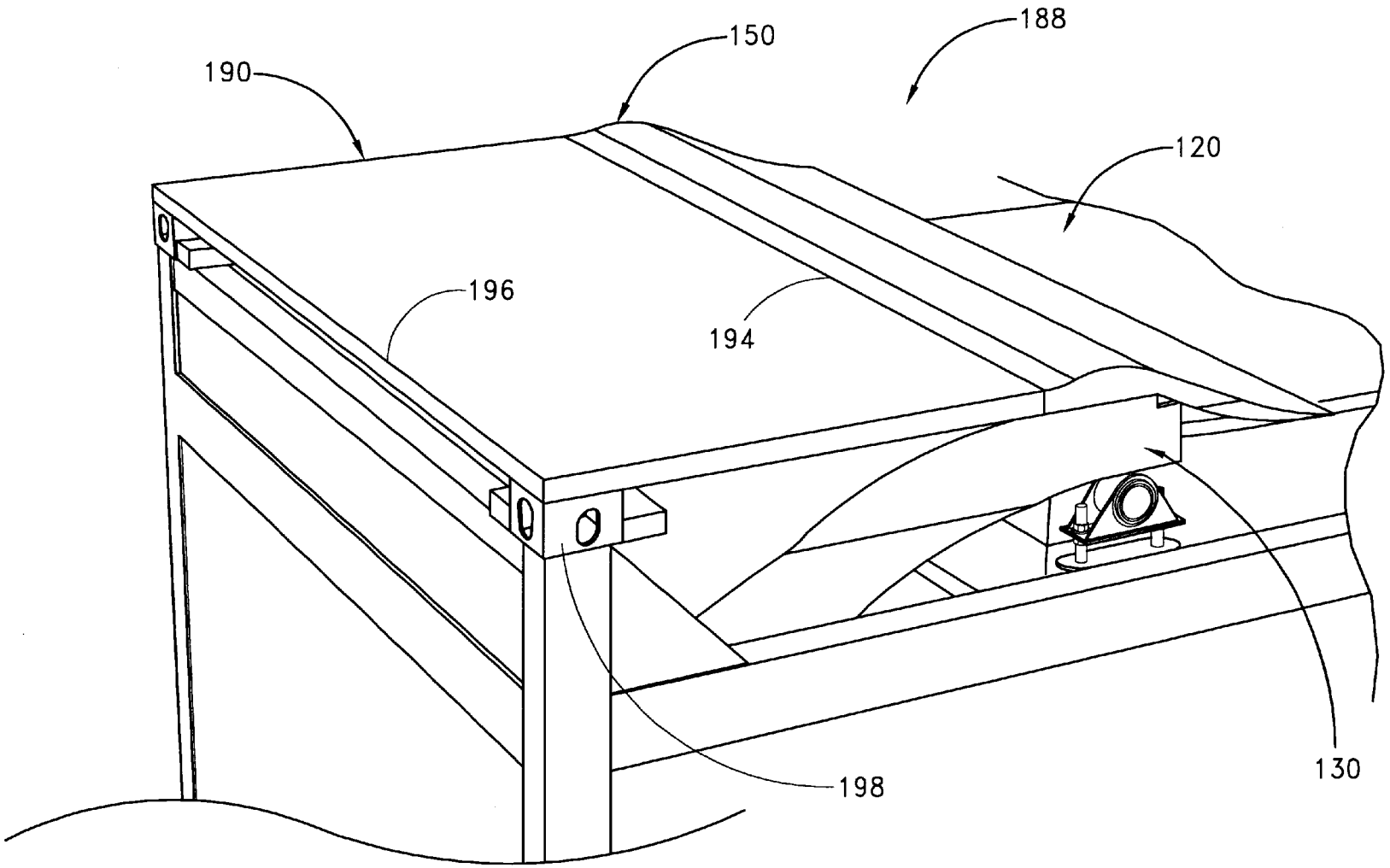
FIG. 3C is a side perspective schematic view of the injection nozzle/sluice assembly of FIG. 3A.
Figure 3D:
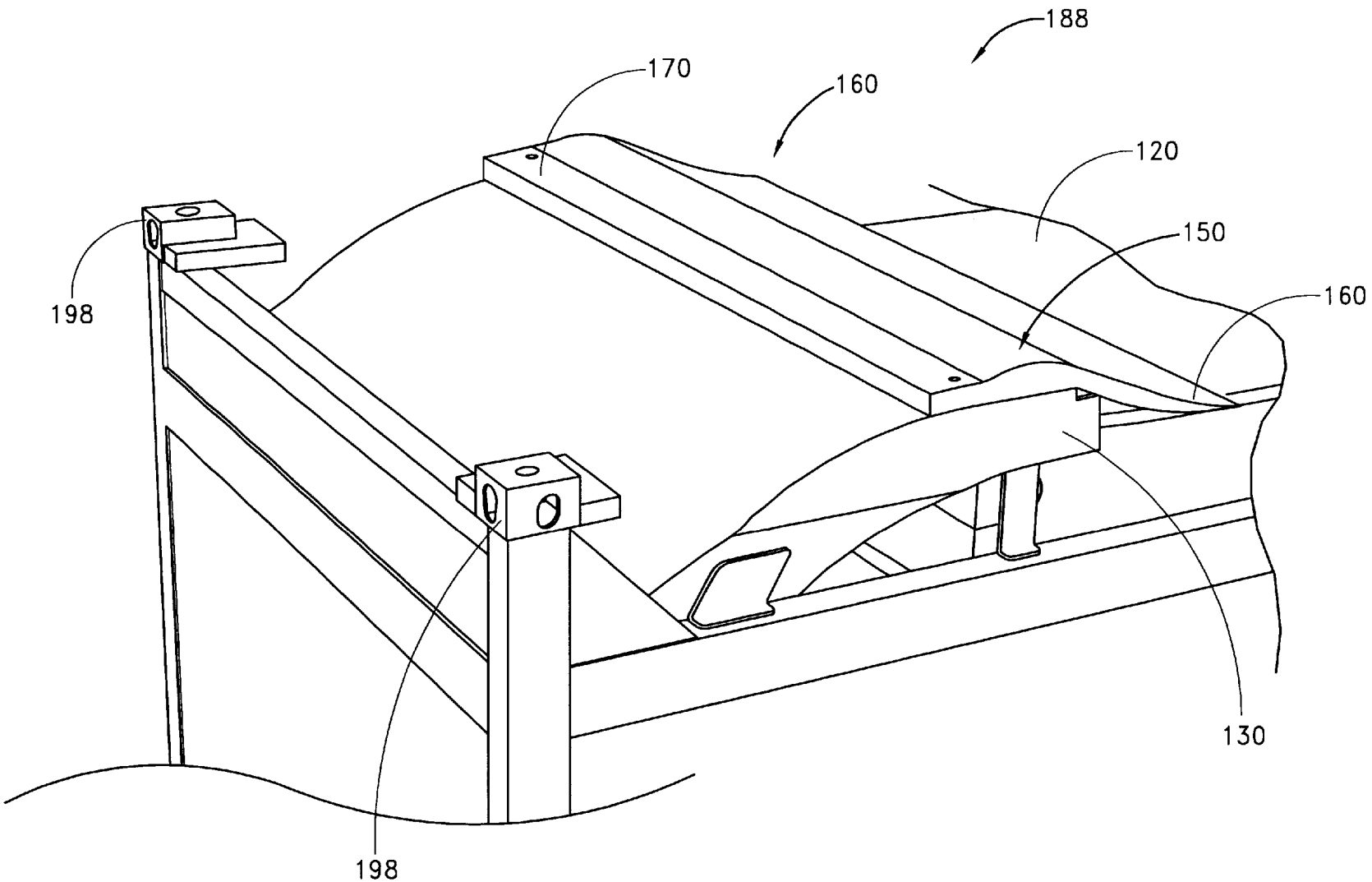
FIG. 3D is a rear perspective schematic view of the injection nozzle/sluice assembly of FIG. 3A with the decking pad removed.

The decking 190 preferably has a thickness of about 2.5 cm (1 inch). The length of the decking 190 is such that the distance between the decking rear end 196 and the nozzle aperture 192 is about 1.63 m (64 inches). The width of the decking is about 2.4 m (8 feet). The decking 190 is positioned such that the its upper surface is about 26.4 cm (10.4 inches) above the upstream end of the ride surface 120. The decking 190 is also positioned such that the distance labeled $L_D$ in FIG. 3A is about 35.6 cm (14 inches). In other preferred embodiments, the padded fixed decking 190 can be efficaciously sized, configured and/or positioned in alternate manners, as required or desired, giving due consideration to the goals of providing a suitable launch/exit pad, ride surface, and/or of achieving one or more of the benefits and advantages as taught or suggested herein.

Preferably, the decking 190 is fabricated from a foam material covered with a plastic to provide additional protection for the riders. In other preferred embodiments, alternate materials may be efficaciously used, as required or desired, giving due consideration to the goals of providing a suitably strong yet safe pad, and/or of achieving one or more of the benefits and advantages as taught or suggested herein.

The padded decking 190 serves several functions. The decking 190 can be used as a launch pad by the rider of the water ride attraction. The rider can then exit the attraction by sliding over the nozzle cover 130 and onto the decking 190, and hence can gracefully or elegantly exit off of the ride surface 120 rather than exiting by being swept, sometimes ungracefully, onto a designated beach area on which a water wave breaks.

The platform 190 and nozzle cover 130 also provide a new dimension in performing water skimming maneuvers and tricks in that a rider may use the wetted slick and/or slippery platform 190 and/or nozzle cover 130 as part of the ride surface. Hence, for example, the rider can skim over the sheet or deep water flow 138 and onto and over the surface of the cover 130 and platform 190 in an alternating or zig-zag pattern or can perform skateboard-like tricks. This adds to the excitement of the water ride attraction and permits a greater range of selection of water skimming or surfing maneuvers.

A plurality of nozzle or sluice-assemblies 188 of the present invention can be employed in a particular water ride attraction, as needed or desired. These nozzle assemblies 188 can be used in conjunction with a sheet or deep water flow ride attraction. The ride surface of the attraction can be a containerless incline or it may be bounded by one or more side and/or end walls. In one preferred embodiment of the present invention, a deep water flow ride attraction comprises one or more of the nozzle assemblies 188 and a ride surface installed in a container.

As noted above, one advantage provided by the nozzle assembly 188 is that it allows for omission or shortening of the extended transition surface, and hence permits construction of compact water ride attractions which can also entertain larger ride surfaces. This compactness can also facilitate in providing water ride attractions that are transportable between different sites. Advantageously, this mobility provides enhanced versatility and convenience and can lower manufacturing and operational costs.

Mobile Modular Water Ride attraction

Accordingly, FIGS. 4A—4D and 5A—5C illustrate preferred embodiments of a mobile injected sheet-flow ride attraction 100 in which the extended transition surface has been omitted or significantly shortened in accordance with the teachings and advantages of the present invention. Preferably, the ride attraction 100 comprises a plurality of nozzle assemblies 188, as illustrated in FIGS. 3A—3D, with each including a slide-over sluice cover 150 and a padded fixed decking 190.

Figure 6A:
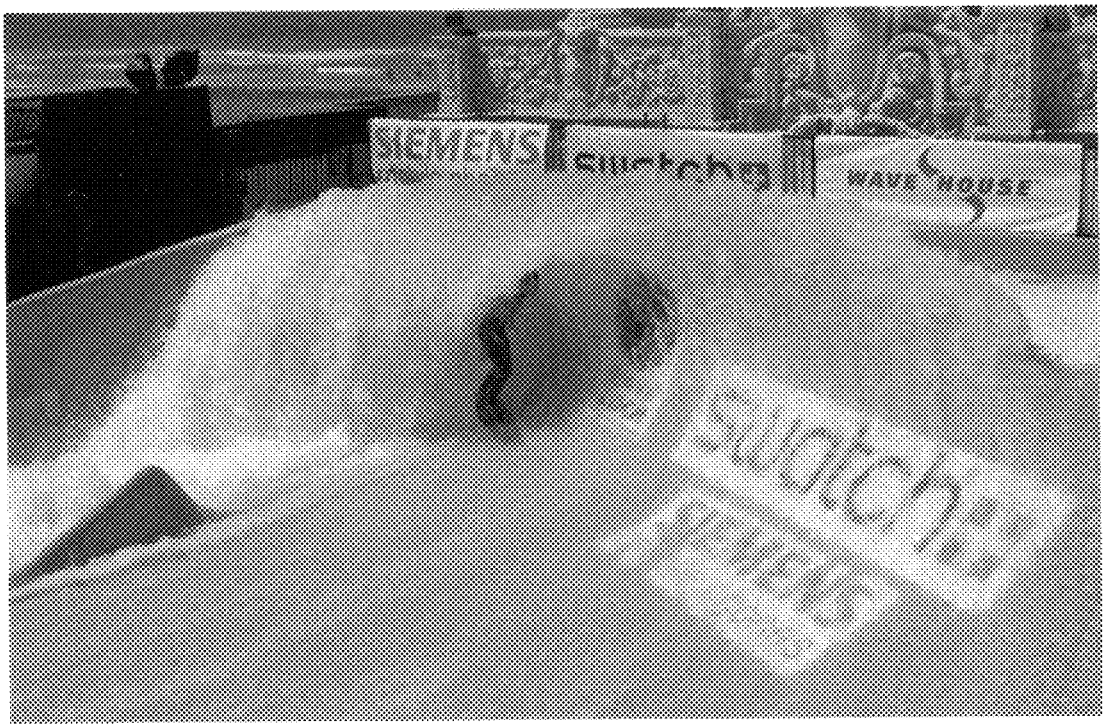
FIG. 6A is a right side front perspective view of the injected sheet-flow wave-simulating water ride attraction of FIG. 4A illustrating the formation of a simulated tunnel wave thereon.
Figure 6B:
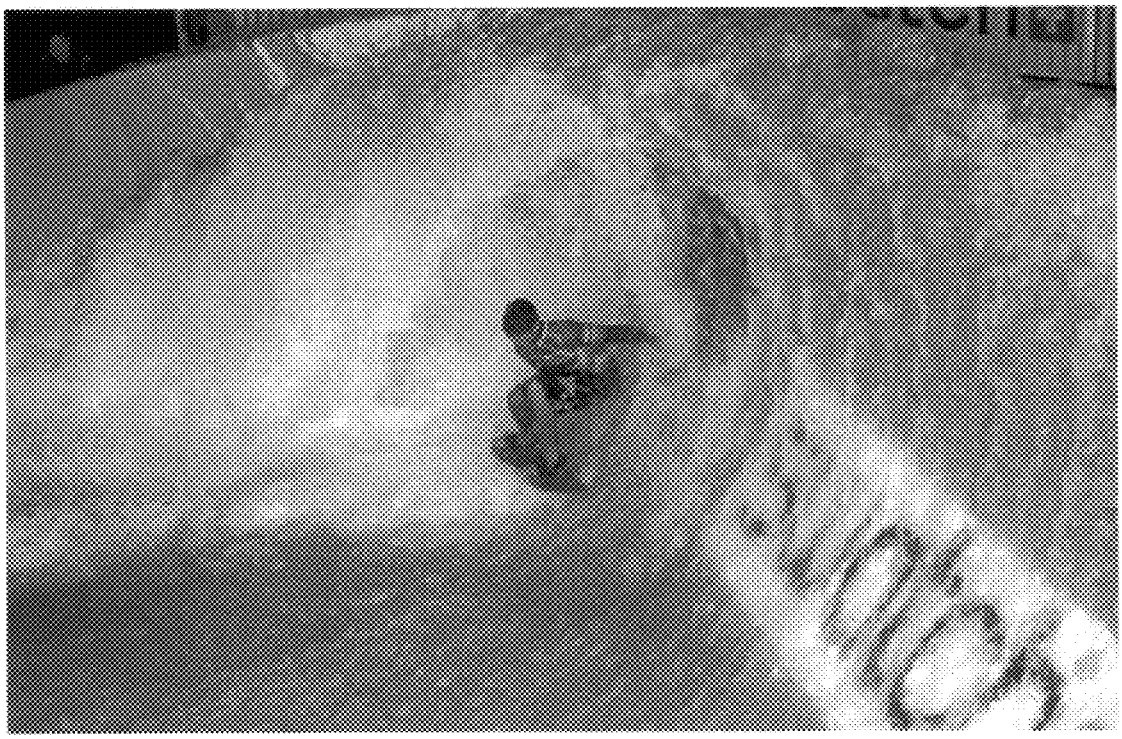
FIG. 6B is a right side front perspective view of the injected sheet-flow wave-simulating water ride attraction of FIG. 4A illustrating the formation of a simulated tunnel wave thereon and a rider riding inside the tunnel wave and on the injected sheet flow.

FIG. 6A is a perspective view of the injected sheet-flow wave-simulating water ride attraction 100 and illustrates the formation of a simulated tunnel wave thereon approximately three meters high. FIG. 6B is a perspective view of the injected sheet-flow wave-simulating water ride attraction 100 illustrating a rider riding inside the simulated tunnel wave and upon the injected sheet water flow.

As discussed in more detail below, the compactness and/or modularity of the water ride attraction 100 advantageously allow it to be transported or shipped between different sites via truck, train or other vehicle. Moreover, the prefabricated components of the ride attraction 100 can be quickly assembled on-site without the need for a time-consuming long, drawn out construction process. This provides enhanced versatility, convenience and also keeps costs low.

Figure 4A:
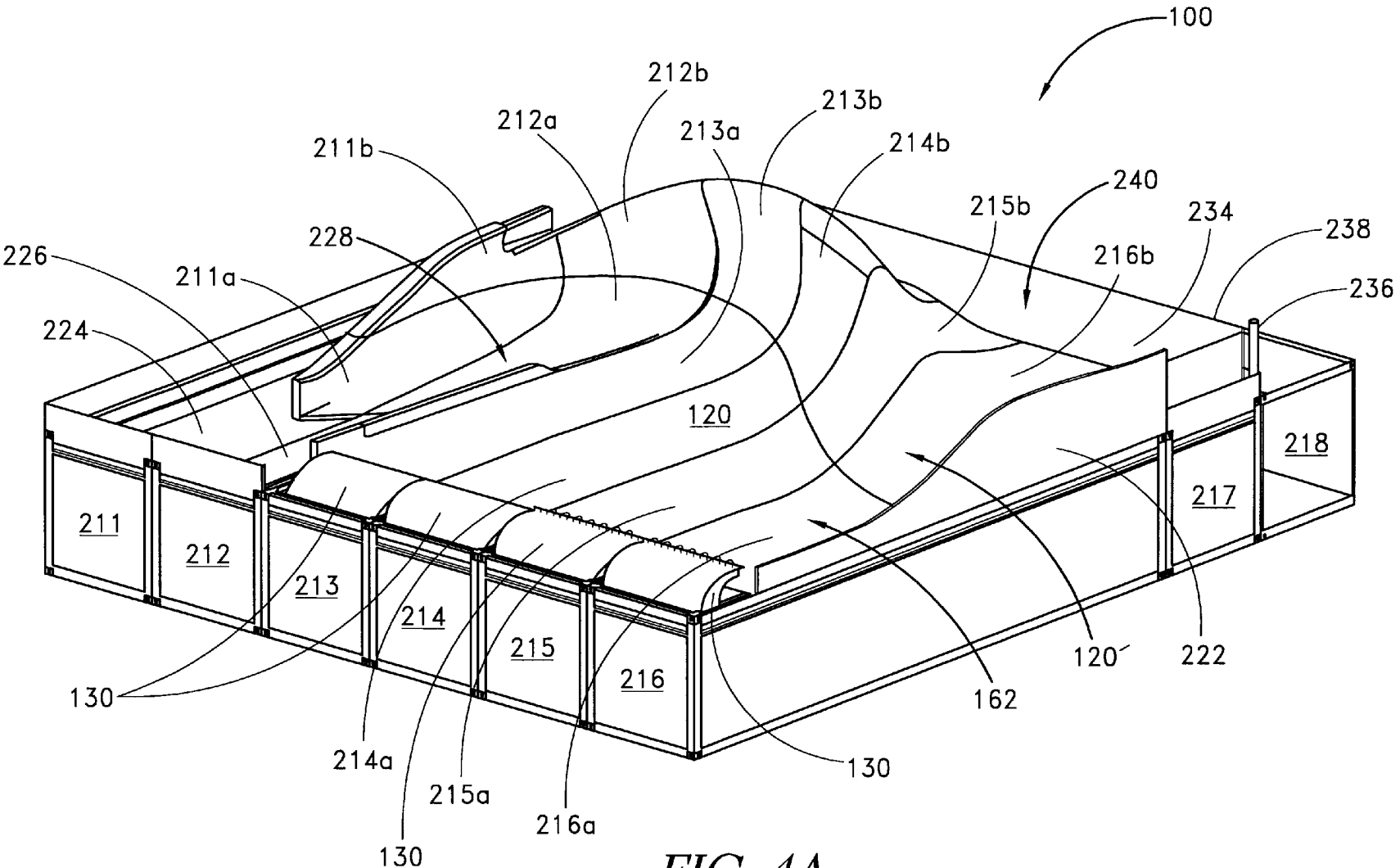
FIG. 4A is a right side front perspective schematic view of an injected sheet-flow wave-simulating water ride attraction having features and advantages in accordance with the present invention.

As best seen in FIG. 4A, the ride surface 120 comprises a sloped portion 120' and a generally flat or horizontal portion 162 with the sloped ride surface 120' nearly adjacent or close to the sheet-flow injection nozzles/sluices 130. As indicated above, advantageously, this increases the available ride area for maximum rider enjoyment and also reduces the overall size of the ride attraction, thus facilitating the creation of larger and more exciting waves in tight spaces, such as in hotels and restaurants.

Referring in particular to FIGS. 4A—4D and 5A—5C, in one preferred embodiment, the water ride attraction 100 comprises a plurality of shippable modules, units or containers 211, 212, 213, 214, 215, 216, 217 and 218. In one preferred embodiment, these containers comprise standard shipping containers/crates.

The independent modules 211, 212, 213, 214, 215, 216, 217 and 218 along with other ride attraction components are transported to the designated site and preferably assembled on-site to form the water ride attraction 100. Preferably, a suitable suspension 250 (FIG. 5A) is provided to keep the ride attraction or machine 100 level. Selected external surfaces of the containers 211, 212, 213, 214, 215, 216, 217 and 218 can be painted to provide an aesthetic appearance, as needed or desired. A similar modular structure can also be efficaciously utilized to provide a mobile deep water flow ride attraction.

The modules 211, 212, 213, 214, 215, 216, 217 and 218 are preferably sized to facilitate truck or train transport such as in a standard shipping crate. Preferably, the modules 211, 212, 213, 214, 215, 216, 217 and 218 include standard IICL5 corner fittings/castings 262 (FIG. 4B) which allow the modules to be brought together and removably connected using standard shipping container/crate bridge fittings, as is known in the art. In other preferred embodiments, the modules can be attached using other fastening devices and mechanisms, such as nut-bolt combinations, screws, locks, clamps and the like, with efficacy, as required or desired, giving due consideration to the goals of securely and removably attaching the modules, and/or of achieving one or more of the benefits and advantages as taught or suggested herein.

Each one of the modules 213, 214, 215, 216 houses a circulation pump 144 which is in fluid communication with a respective flow forming nozzle 130 which emits a supercritical water flow 138 onto the contoured ride surface 120. Preferably, a tongue-like pad 150 (FIGS. 3A—3D) and a padded fixed decking 190 (FIGS. 3A—3D) is provided with each nozzle 130, as discussed above. In another preferred embodiment, a single tongue-like pad/cover 150 and/or padded fixed decking 190 is utilized with the plurality of nozzles 130 and attached after assembly of the modules 213, 214, 215, 216. The four pumps 144 move water in the four containers 213, 214, 215, 216 beneath the wave and the ride surface 120, and provide it to respective nozzles or sluices 130.

Ride surfaces 213*a*, 213*b* are associated with the module or container 213. The ride surfaces 213*a*, 213*b* comprise a portion of the contoured ride surface 120. Preferably, ride surface 213*b* is removed or detached from the module 213 during transport, to facilitate transportation of the module 213, ride surface 213*b* and/or other components of the water ride attraction 100. At the designated site, and during assembly of the ride attraction 100, the ride surface 213*b* is reattached to the module 213.

Ride surfaces 214*a*, 214*b* are associated with the module or container 214. The ride surfaces 214*a*, 214*b* comprise a portion of the contoured ride surface 120. Preferably, ride surface 214*b* is removed or detached from the module 214 during transport, to facilitate transportation of the module 214, ride surface 214*b* and/or other components of the water ride attraction 100. At the designated site, and during assembly of the ride attraction 100, the ride surface 214*b* is reattached to the module 214. The ride surface 214*b* can also comprise two removably attachable surfaces, as needed or desired.

Ride surfaces 215*a*, 215*b* are associated with the module or container 215. The ride surfaces 215*a*, 215*b* comprise a portion of the contoured ride surface 120. Preferably, ride surface 215*b* is removed or detached from the module 215 during transport, to facilitate transportation of the module 215, ride surface 215*b* and/or other components of the water ride attraction 100. At the designated site, and during assembly of the ride attraction 100, the ride surface 215*b* is reattached to the module 215.

Ride surfaces 216*a*, 216*b* are associated with the module or container 216. The ride surfaces 216*a*, 216*b* comprise a portion of the contoured ride surface 120. Preferably, ride surface 216*b* is removed or detached from the module 216 during transport, to facilitate transportation of the module 216, ride surface 216*b* and/or other components of the water ride attraction 100. At the designated site, and during assembly of the ride attraction 100, the ride surface 216*b* is reattached to the module 216.

Preferably, a flow fence or side wall 222 is associated with the module or container 216. The flow control fence 222 serves to avoid spillage and wastage of the water flowing on the ride surface 120 and can also function as a safety fence. Preferably, flow fence 222 is removed or detached from the module 216 during transport, to facilitate transportation of the module 216, flow fence 222 and/or other components of the water ride attraction 100. At the designated site, and during assembly of the ride attraction 100, the flow fence 222 is reattached to the module 216.

In one preferred embodiment, the contoured surface 120 is configured with shoulders 230 and curls 232 (labeled in FIG. 4D) to create waves of a preselected or predetermined configuration. The ramp or curls 232 form a lip that causes the breaking and/or tunneling wave effect. The skilled artisan will readily recognize that in other preferred embodiments, the contoured surface 120 can be configured and/or shaped in alternate manners with efficacy, as required or desired, giving due consideration to the goals of providing a preselected or predetermined wave and/or flow structure, and/or of achieving one or more of the benefits and advantages as taught or suggested herein.

The top of the splash down module 211 preferably includes a mat over porous grating or drain area 224. Surfaces or walls 211*a*, 211*b* are associated with the module or container 211. Preferably, ride surface 211*b* is removed or detached from the module 211 during transport, to facilitate transportation of the module 211, ride surface 211*b* and/or other components of the water ride attraction 100. At the designated site, and during assembly of the ride attraction 100, the ride surface 211*b* is reattached to the module 211.

The grates 224, 226 can hold riders coming off a wave and in combination with one or more of the surfaces/walls 211*a*, 211*b*, 212*a*, 212*b* form a beaching area 228. One or more of the surfaces/walls 211*a*, 211*b*, 212*a*, 212*b* can also form a flow control and/or safety fence. The grates or drains 224, 226 allow water 138*a* (FIG. 4D) to flow down into respective containers 211, 212. The drained water from container 211 then flows into container 212 which directs it along with its own collected drained water to the catch pool or container 217.

The top of the upper splash down module 217 preferably includes a mat over porous grating or drain area 234. One or more posts 236 and a tensioned fabric splash guard and/or safety fence 238 are associated with the top of module or container 217. Preferably, posts 236 and/or splash guard 238 are removed or detached from the module 217 during transport, to facilitate transportation of the module 217, posts 236, splash guard 238 and/or other components of the water ride attraction 100. At the designated site, and during assembly of the ride attraction 100, the posts 236 and/or splash guard 238 are reattached to the module 217. A drain pipe 260 or the like is also connected to the container 217 for draining water into a waste position, as needed or required.

Figure 4D:
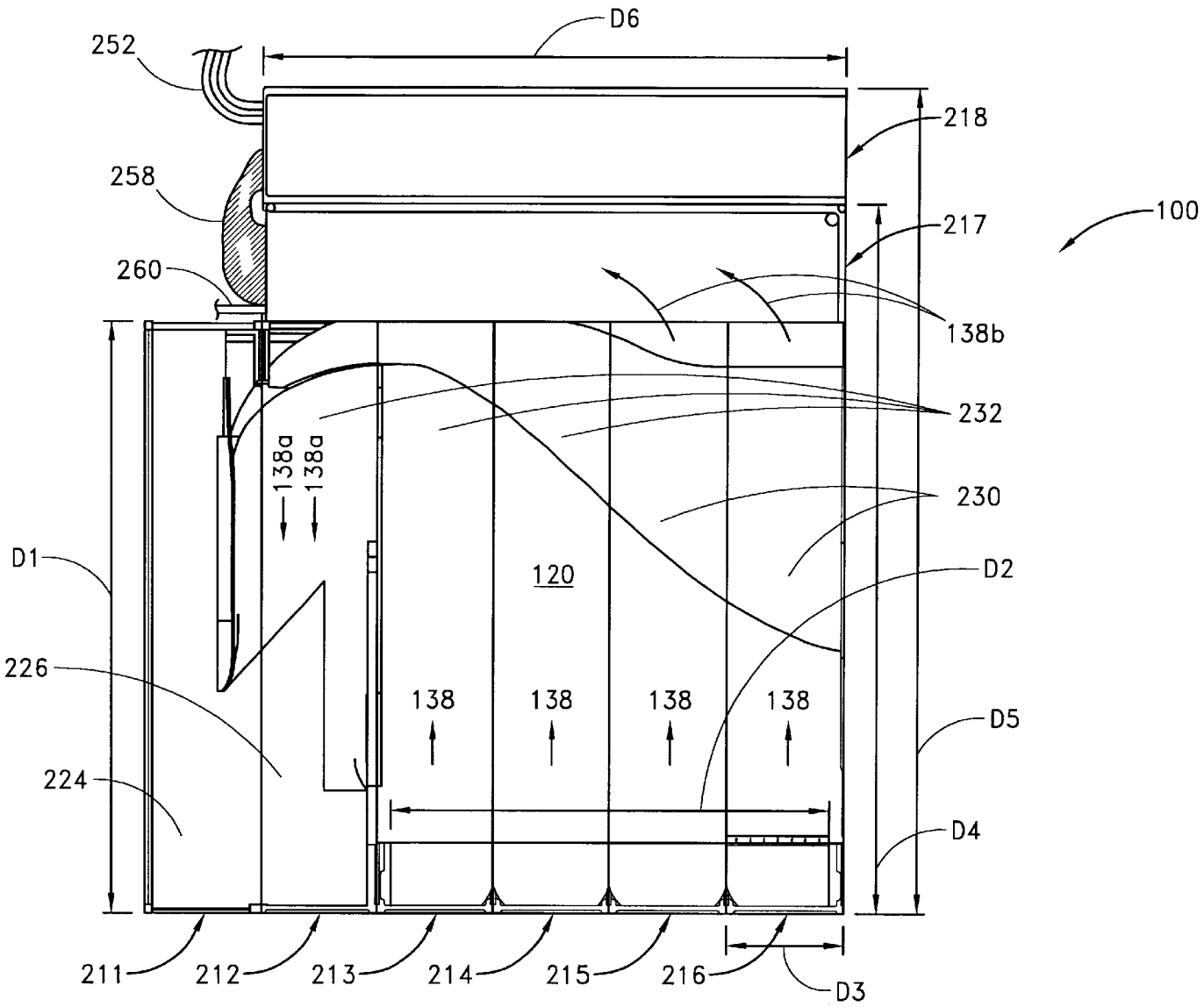
FIG. 4D is a top plan schematic view of the water ride attraction of FIG. 4A.
Figure 5A:
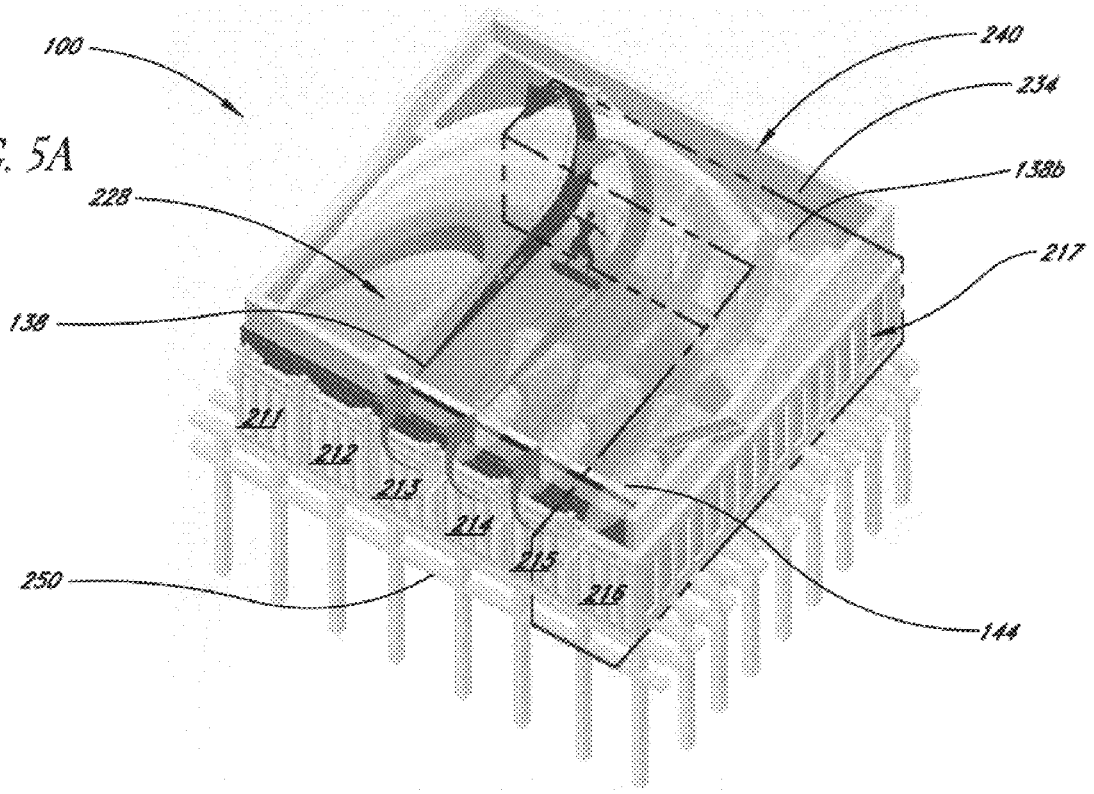
FIG. 5A is a right side front perspective schematic view of another preferred embodiment of an injected sheet-flow wave-simulating water ride attraction having features and advantages in accordance with the present invention.

The grate 234 can hold riders exiting the ride attraction 100 while keeping the riders distanced from the pumps 144 and also forms a beaching area 240. The grate or drain 234 allows water or water flow 138*b* (FIGS. 4D, 5A and 5B)

overflowing from the ride to flow down into the container or catch pool 217. This water 138*b* along with drained water from the containers 211, 212 is directed by the catch pool 217 through openings 242 (FIG. 5B) back towards the pumps 144 as water or water flow 138*c* (FIGS. 5B and 5C).

Figures 5B, 5C:
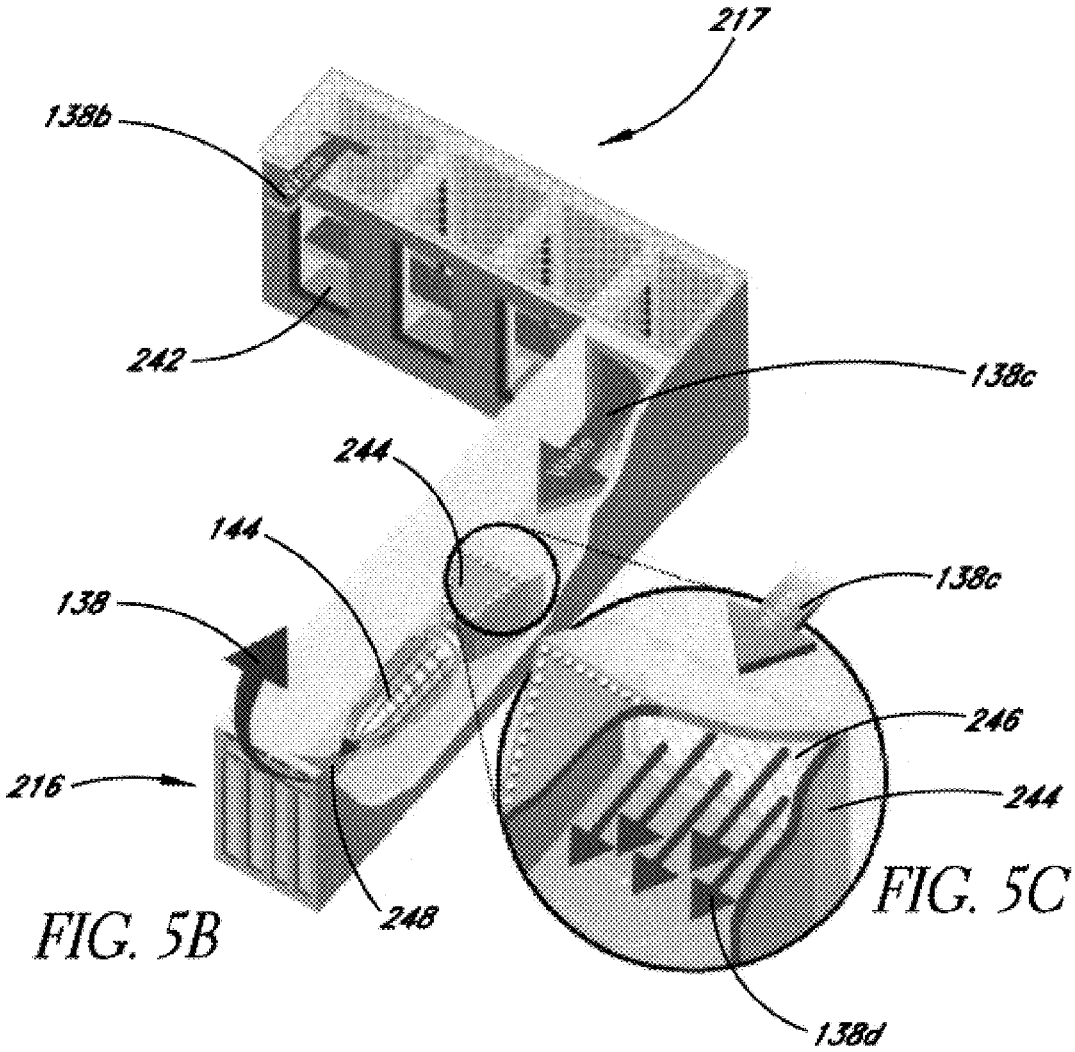
FIG. 5B is an exploded schematic view illustrating the path of the recirculated water flow through the water ride attraction of FIG. 5A.
FIG. 5C is an exploded schematic view illustrating the path of the water flow into the pump of FIG. 5B.

As best seen in FIGS. 5B–5C, preferably, the water 138*c* enters chambers 244, which have a reducing area in the downstream direction, through honey-combed shaped openings 246, thereby increasing the pressure as the water 138*d* enters the pumps 144. The pumps 144 push the water through respective reducers 248 which further increases the pressure and into respective nozzles 130. In this particular configuration the water from the pumps 144 is forced upward and over backwards, turning the water upwardly about 180°. The nozzles 130 shoot or jet the supercritical water flow 138 onto the foam ride surface 120 having contoured and shaped surfaces and/or ramps to form a wave of predetermined or preselected configuration.

Referring again to FIGS. 4A–4D, the module 218 preferably comprises a control and filtration closed top container which is responsible for controlling and monitoring the operation of the water ride attraction 100. The module 218 is connected to power lines 252 from one or more generators. The module 218 houses a plurality of control panels 254 and a filtration system 256. Various cabling and/or lines 258 are associated with module 218 such as power cables, signal cables, source and filtered water line(s), fill level control, system drain line and the like.

Each of the nozzles 130 and/or pumps 144 preferably provides a water flow rate of about 1700 liters/sec (27,000 gallons/minute or GPM) for a total flow rate of about 6800 liters/sec (108,000 GPM) onto the ride surface 120 to form a preferred wave structure. Of this total flow rate about two-third or 1130 liters/sec (72,000 GPM) exits the ride surface as water 138*a* via the grates 224, 226 and about one-third or 570 liters/sec (36,000 GPM) overflows as water 138*b* into the grate 234. The drained water is then recirculated from the catch pool 217 to the pumps 144. In other preferred embodiments, different flow rates and fewer or more nozzles, pumps and/or modules can be efficaciously used, as required or desired, giving due consideration to the goals of providing a predetermined or preselected wave form and/or flow structure, and/or of achieving one or more of the benefits and advantages as taught or suggested herein.

Referring in particular to FIG. 4A, the ride surfaces 213*a*, 214*a*, 215*a*, 216*a*, 215*b* and 216*b* have top surface areas of about 22.9 $m^2$ (247 sq ft), 19.5 $m^2$ (210 sq ft), 14.3 $m^2$ (154 sq ft), 10.4 $m^2$ (112 sq ft), 12.6 $m^2$ (136 sq ft) and 13.4 $m^2$ (144 sq ft), respectively. The ride surfaces 213*b* and 214*b* have top (including back) surface areas of about 9.6 $m^2$ (103 sq ft) and 12.4 $m^2$ (133 sq ft), respectively. The surfaces 211*a*, 211*b* and 212*a* have top surface areas of about 6.8 $m^2$ (73 sq ft), 3.3 $m^2$ (35 sq ft) and 18.7 $m^2$ (201 sq ft), respectively. The surface 212*b* has a top (including back) surface area of about 8.1 $m^2$ (87 sq ft). In other preferred embodiments, the surfaces 211*a*, 211*b*, 212*a*, 212*b*, 213*a*, 213*b*, 214*a*, 214*b*, 215*a*, 215*b*, 216*a*, 216*b* can be efficaciously sized and configured in alternate manners, as required or desired, giving due consideration to the goals of achieving one or more of the benefits and advantages as taught or suggested herein.

Figure 4B:
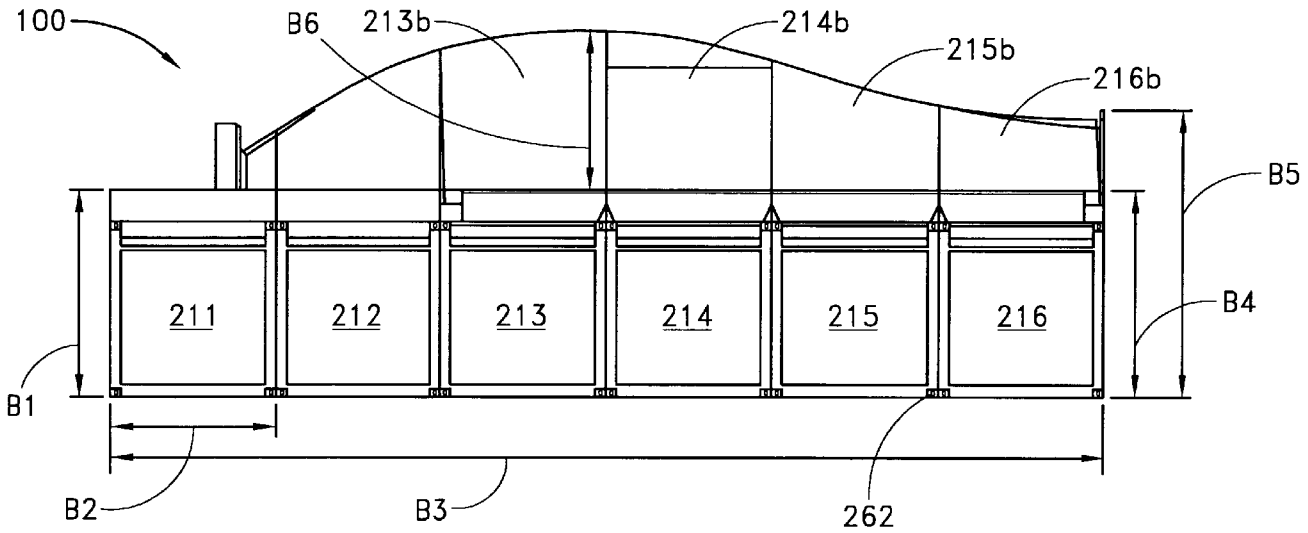
FIG. 4B is a front elevational schematic view of the water ride attraction of FIG. 4A.

Referring in particular to FIG. 4B, the dimensions B1, B2, B3, B4, B5 and B6 are about 3.048 m (10 ft), 2.438 m (8 ft), 14.63 m (48 ft), 2.591 m (8.5 ft), 4.249 m (13.94 ft) and 2.355 m (7.729 ft), respectively. In other preferred embodiments, the ride attraction 100 can be sized and/or configured in other manners with efficacy, as required or desired, giving due consideration to the goals of providing a compact and/or mobile ride attraction having modules and components that are transportable between sites, and/or of achieving one or more of the benefits and advantages as taught or suggested herein.

Figure 4C:
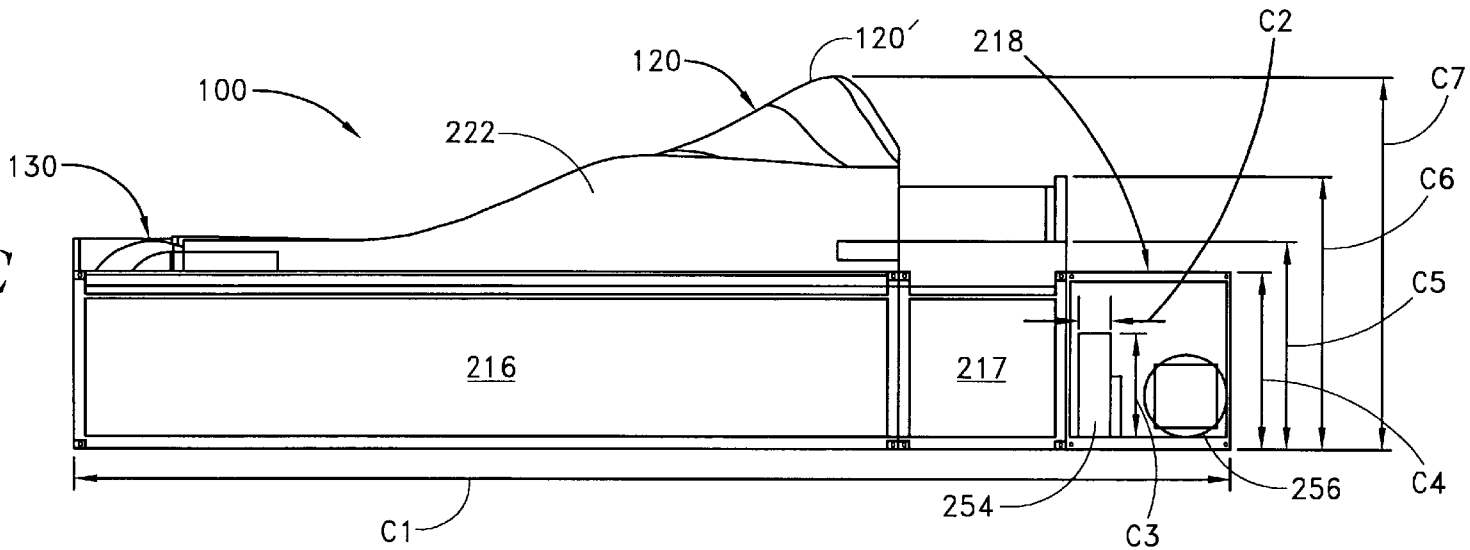
FIG. 4C is a right side elevational schematic view of the water ride attraction of FIG. 4A.

Referring in particular to FIG. 4C, the dimensions C1, C2, C3, C4, C5, C6 and C7 are about 17.069 m (56 ft), 0.457 m (1.5 ft), 1.524 m (5 ft), 2.591 m (8.5 ft), 3.023 m (9.917 ft), 3.962 m (13 ft) and 5.41 m (17.75 ft), respectively. In other preferred embodiments, the ride attraction 100 can be sized and/or configured in other manners with efficacy, as required or desired, giving due consideration to the goals of providing a compact and/or mobile ride attraction having modules and components that are transportable between sites, and/or of achieving one or more of the benefits and advantages as taught or suggested herein.

Referring in particular to FIG. 4D, the dimensions D1, D2, D3, D4, D5 and D6 are about 12.192 m (40 ft), 9.144 m (30 ft), 2.438 m (8 ft), 14.63 m (48 ft), 17.069 m (56 ft) and 12.192 m (40 ft), respectively. In other preferred embodiments, the ride attraction 100 can be sized and/or configured in other manners with efficacy, as required or desired, giving due consideration to the goals of providing a compact and/or mobile ride attraction having modules and components that are transportable between sites, and/or of achieving one or more of the benefits and advantages as taught or suggested herein.

The major footprint of the water ride attraction 100 is about 14.63 m (48 ft)×17.069 m (56 ft). The modules or containers 211, 212, 213, 214, 215, 216, 217, 218 have a width of about 2.438 m (8 ft), a length of about 12.192 m (40 ft) and a height of about 2.591 m (8.5 ft). Advantageously, this size configuration permits the modules or containers 211, 212, 213, 214, 215, 216, 217, 218 to be shipped or transported using suitable trucks, trains or other vehicles. In other preferred embodiments, the ride attraction 100 can be sized and/or configured in other manners with efficacy, as required or desired, giving due consideration to the goals of providing a compact and/or mobile ride attraction having modules and components that are transportable between sites, and/or of achieving one or more of the benefits and advantages as taught or suggested herein.

While the components and techniques of the present invention have been described with a certain degree of particularity, it is manifest that many changes may be made in the specific designs, constructions and methodology hereinabove described without departing from the spirit and scope of this disclosure. It should be understood that the invention is not limited to the embodiments set forth herein for purposes of exemplification, but is to be defined only by a fair reading of the appended claims, including the full range of equivalency to which each element thereof is entitled.

What is claimed is:

1. A nozzle assembly for a water ride attraction, comprising:

a nozzle having an outlet aperture adapted to emit a jet of water onto a ride surface; and a nozzle cover comprising a padded material substantially covering said nozzle and including a flexible tongue which is biased downward against the flow of the water to prevent injury to riders riding over said nozzle.

2. The nozzle assembly of claim 1, wherein said nozzle cover comprises a polyurethane foam.

3. The nozzle assembly of claim 1, wherein said nozzle cover is removably connected to said nozzle.

4. The nozzle assembly of claim 1, wherein said nozzle cover has varying thickness ranging between about 1.6 mm to about 25.4 mm.

5. The nozzle assembly of claim 1, wherein said tongue is spring biased downward against the flow of the water.

6. The nozzle assembly of claim 1, wherein said nozzle has a generally beak like shape.

7. The nozzle assembly of claim 1, wherein said nozzle is constructed to withstand pressures in the range from about 55 kilopascals to about 310 kilopascals.

8. The nozzle assembly of claim 1, wherein said nozzle withstand pressures in the range from about 14 kilopascals to about 310 kilopascals.

9. The nozzle assembly of claim 1, wherein said aperture has a vertical opening of about 8 cm.

10. The nozzle assembly of claim 1, wherein said aperture has a vertical opening of about 61 cm.

11. The nozzle assembly of claim 1, wherein said aperture has a vertical opening in the range from about 4 cm to about 30 cm.

12. The nozzle assembly of claim 1, wherein said aperture has a vertical opening in the range from about 30 cm to about 1.8 m.

13. The nozzle assembly of claim 1, wherein said outlet aperture is configured to emit a sheet flow of water.

14. The nozzle assembly of claim 1, wherein said outlet aperture is configured to emit a deep flow of water.

15. The nozzle assembly of claim 1, further comprising a padded fixed decking.

16. The nozzle assembly of claim 1, in combination with a ride surface which is contoured to form a predetermined or preselected wave structure and/or flow pattern to form a transportable module.

17. A cover for a water ride sluice gate from which a flow of water jets out, comprising a contoured flexible pad, a connector configured to removably affix the cover to said sluice gate, a flexible tongue at a downstream end of the cover, the tongue configured to extend over the water that jets from said sluice gate, and a generally flat portion at an upstream end of the cover, said tongue being urged downward against the flow of water jetting from said sluice gate.

18. The cover of claim 17, wherein said cover comprises a closed cell polyurethane foam.

19. The cover of claim 17, wherein said cover is coated with a rubber.

20. The cover of claim 17, wherein said cover is coated with a plastic.

21. The cover of claim 17, wherein said cover is coated with polyurethane paint.

22. The cover of claim 17, wherein said cover is coated with vinyl laminate.

23. The cover of claim 17, wherein said cover has a thickness ranging between about 1.6 mm to about 25.4 mm.

24. A water ride attraction, comprising:

a contoured ride surface;

a sluice sized and configured to inject a flow of water onto said ride surface; and a cover which covers and extends over the top surface of said sluice to prevent riders from possibly colliding with or riding over said sluice and/or interfering with the ride operation.

25. The water ride attraction of claim 24, wherein a substantial portion of said ride surface is sloped.

26. The water ride attraction of claim 24, wherein said cover comprises a tongue-like pad.

27. The water ride attraction of claim 24, wherein said outlet aperture is configured to emit a sheet water flow.

28. The water ride attraction of claim 24, wherein said outlet aperture is configured to emit a deep water flow.

29. The water ride attraction of claim 24, further comprising a circulation pump.

30. The water ride attraction of claim 24, further comprising a decking for performing surfing/skimming tricks.

31. A mobile water ride attraction, comprising:

a plurality of nozzle assemblies with each nozzle assembly comprising:

a nozzle having an aperture and being adapted to inject a jet of water;

a nozzle cover comprising a flexible padded material to protect riders from possible injurious contact with said nozzle; and a plurality of transportable modules and associated components which when assembled form a ride surface which is contoured to form a predetermined or preselected wave structure and/or flow pattern.

32. The mobile water ride attraction of claim 31, wherein at least one of said modules houses a pump.

33. The mobile water ride attraction of claim 31, wherein the top surface of at least one of said modules includes a porous grating.

34. The mobile water ride attraction of claim 31, wherein a substantial portion of said ride surface is inclined.

35. The mobile water ride attraction of claim 31, further comprising a padded fixed decking.

36. The mobile water ride attraction of claim 31, wherein said ride surface is contoured to form a tunnel wave.

37. A method of providing a compact wave-simulating water ride attraction comprising a sluice gate having an outlet for injecting a flow of water onto a ride surface, said method comprising the steps of covering said sluice gate with a padded material having a flexible tongue extending over the flow of water emitted from said sluice gate outlet; and biasing said tongue downwards to squeeze said tongue against the flow of water emitted from said sluice gate outlet to seal off said sluice gate outlet from possible injurious contact with a rider, whereby said ride surface is configured to have a substantially inclined ride surface and a shortened horizontal transition surface.

38. A nozzle assembly for a water ride attraction having a ride surface, the nozzle assembly comprising:

a nozzle having an outlet aperture adapted to emit a jet of water onto the ride surface; and a nozzle cover comprising a padded material and including, a flexible tongue which is biased downward toward the jet of water so as to shield the outlet aperture from contact with riders riding over said nozzle.

39. The nozzle assembly of claim 38, wherein the tongue is spring biased downward toward the jet of water.

40. The nozzle assembly of claim 39, wherein an upper surface of the tongue is sloped upwardly.

41. The nozzle assembly of claim 38, additionally comprising a padded fixed decking disposed adjacent the nozzle cover.

42. A nozzle assembly for a water ride attraction, comprising:

a nozzle having an outlet adapted to emit a flow of water onto a ride surface; and a nozzle cover comprising a contoured flexible pad being removably affixed to said nozzle, said nozzle cover including a flexible tongue at a downstream end extending over the water that flows from said outlet, said tongue being urged downward against the flow of water from said outlet.

43. The nozzle assembly of claim 42, wherein the nozzle cover has a generally flat portion at an upstream end of the cover.

44. The nozzle assembly of claim 42, wherein the cover has a thickness ranging between about 1.6 mm to about 25.4 mm.

45. The nozzle assembly of claim 42, wherein the cover comprises a closed cell polyurethane foam.

46. The cover of claim 42, wherein said cover is coated with a rubber.

47. The cover of claim 42, wherein said cover is coated with a plastic.

48. The cover of claim 42, wherein said cover is coated with polyurethane paint.

49. The cover of claim 42, wherein said cover is coated with vinyl laminate.

50. A mobile water ride attraction, comprising:

a plurality of transportable propulsion modules, each of the propulsion modules comprising:

a circulation pump; and a flow forming nozzle in fluid communication with the circulation pump and configured to emit a flow of water;

wherein the propulsion modules are configured to be connected to one another to form a water propulsion system;

a plurality of transportable ride surface modules, the ride surface modules configured to be connected to one another to form a ride surface; and a padded cover, wherein the propulsion system and the ride surface are configured to be connected to one another so that the flowing forming nozzles emit a flow of water onto the ride surface, and the padded cover extends over at least one of the nozzles.

51. The mobile water ride of claim 50, wherein at least one of the ride surface modules is incorporated into one of the propulsion modules.

52. The mobile water ride of claim 50, wherein the cover comprises a plurality of sections and each of the propulsion modules include a section of the cover.

53. The mobile water ride of claim 50, wherein the cover is formed separately from the propulsion modules and the cover is configured to be releasably attached to at least two propulsion modules.

54. The mobile water ride of claim 50, additionally comprising a suspension system configured to maintain the propulsion system in a generally level disposition.

55. The mobile water ride of claim 50, wherein the cover is configured to extend over the nozzles and into contact with the flow of water emitted by the nozzles.

56. The mobile water ride of claim 55, wherein the ride surface comprises a generally flat transition section and an upwardly inclined ramp portion, a first end of the transition portion being disposed adjacent the nozzles and a second end of the transition portion intersecting the ramp portion, the ramp portion having a maximum height, and a maximum length from the first end to the second end of the transition portion is less than three times the maximum height of the ramp portion.

57. The mobile water ride of claim 56, wherein the length of the transition surface is configured so that a rider can ride down the ramp portion to and across the transition portion and onto the cover.

* * * * *

UNITED STATES PATENT AND TRADEMARK OFFICE

CERTIFICATE OF CORRECTION

PATENT NO. : 6,491,589 B1
APPLICATION NO. : 09/630878
DATED : December 10, 2002
INVENTOR(S) : Thomas J. Lochtefeld It is certified that error appears in the above-identified patent and that said Letters Patent is hereby corrected as shown below:

In column 6, line 39, delete "$F_r < 1 \rightarrow V < \sqrt{gd}$" and insert -- $F_r > 1 \rightarrow V > \sqrt{gd}$ -- therefore.

In column 10, line 62, delete "The sluice cover or pad 130" and insert --The sluice cover or pad 150-- therefore.

In column 10, line 66, delete "the sluice cover 130" and insert --the sluice cover 150-- therefore.

In column 11, line 5, delete "The sluice cover or pad 130" and insert --The sluice cover or pad 150-- therefore.

In column 11, line 11, delete "The pad 130" and insert --The pad 150-- therefore.

In column 11, line 26, delete "surfaces of the cover 130" and insert --surfaces of the cover 150-- therefore.

In column 11, line 59, delete "the nozzle cover 130" and insert --the nozzle cover 150-- therefore.

In column 11, line 64, delete "and nozzle cover 130" and insert --and nozzle cover 150-- therefore.

In column 11, line 67, delete "and/or nozzle cover 130" and insert --and/or nozzle cover 150-- therefore.

In column 12, line 3, delete "of the cover 130" and insert --of the cover 150-- therefore.

In column 17, lines 8-9, delete "wherein said nozzle withstand" and insert --wherein said nozzle is constructed to withstand-- therefore.

In column 17, lines 62-63, delete "said outlet aperture" and insert --said sluice-- therefore.

In column 17, lines 64-65, delete "said outlet aperture" and insert --said sluice-- therefore.

Signed and Sealed this
Tenth Day of April, 2012

David J. Kappos

David J. Kappos
*Director of the United States Patent and Trademark Office*

In column 18, line 45, delete “including, a flexible tongue” and insert --including a flexible tongue-- therefore.

In column 19, lines 29-30, delete “so that the flowing forming nozzles” and insert --so that the flow forming nozzles-- therefore.

In column 20, line 5, delete “comprises a plurality of sections and” and insert --comprises a plurality of sections, and-- therefore.

In column 20, line 8, delete “from the propulsion modules and” and insert --from the propulsion modules, and-- therefore.